US009601816B2

(12) United States Patent
Tomaki et al.

(10) Patent No.: US 9,601,816 B2
(45) Date of Patent: Mar. 21, 2017

(54) DIELECTRIC LINE AND ELECTRONIC COMPONENT

(71) Applicant: TDK CORPORATION, Tokyo (JP)

(72) Inventors: Shigemitsu Tomaki, Tokyo (JP); Tomoaki Kawata, Tokyo (JP); Kiyoshi Hatanaka, Tokyo (JP); Toshio Sakurai, Tokyo (JP); Yasunori Sakisaka, Tokyo (JP)

(73) Assignee: TDK CORPORATION, Tokyo (JP)

( * ) Notice: Subject to any disclaimer, the term of this patent is extended or adjusted under 35 U.S.C. 154(b) by 152 days.

(21) Appl. No.: 14/340,880

(22) Filed: Jul. 25, 2014

(65) Prior Publication Data

US 2015/0035626 A1 Feb. 5, 2015

(30) Foreign Application Priority Data

Aug. 2, 2013 (JP) ..... 2013-160916

(51) Int. Cl.
*H01P 7/00* (2006.01)
*H01P 1/20* (2006.01)
(Continued)

(52) U.S. Cl.
CPC ..... *H01P 1/2002* (2013.01); *H01P 3/16* (2013.01); *H01P 7/10* (2013.01)

(58) Field of Classification Search
CPC ..... H03H 5/00; H03H 5/006; H03H 7/0115; H01F 27/327
(Continued)

(56) References Cited

U.S. PATENT DOCUMENTS 6,091,310 A * 7/2000 Utsumi ..... H01L 23/645 174/262
8,081,050 B2 * 12/2011 Kaneda ..... H01P 1/20345 333/204
(Continued)

FOREIGN PATENT DOCUMENTS

JP A-4-43703 2/1992
JP A-10-13112 1/1998
(Continued)

OTHER PUBLICATIONS

Her4bert A. Pohl, "Giant Polarization in High Polymers", 1985, IEEE, p. 271.*
(Continued)

*Primary Examiner* — Robert Pascal
*Assistant Examiner* — Kimberly Glenn
(74) *Attorney, Agent, or Firm* — Oliff PLC

(57) ABSTRACT

A dielectric line includes a line portion and a surrounding dielectric portion. The line portion is formed of a first dielectric having a first relative permittivity. The surrounding dielectric portion is formed of a second dielectric having a second relative permittivity. The line portion propagates one or more electromagnetic waves of one or more frequencies within the range of 1 to 10 GHz. In a cross section orthogonal to the direction of propagation of the one or more electromagnetic waves through the line portion, the surrounding dielectric portion is present around the line portion. The first relative permittivity is 1,000 or higher. The second relative permittivity is lower than the first relative permittivity.

9 Claims, 26 Drawing Sheets

(51) Int. Cl.
*H01P 7/10* (2006.01)
*H01P 3/16* (2006.01)

(58) Field of Classification Search
USPC ..... 333/185, 219, 222, 204, 205, 182, 202, 333/207, 208
See application file for complete search history.

(56) References Cited

U.S. PATENT DOCUMENTS

| | | | | |
|---|---|---|---|---|
| 2003/0080830 | A1* | 5/2003 | Matsumura ..... | H03H 7/0115 333/185 |
| 2013/0027155 | A1* | 1/2013 | Feichtinger ..... | H01G 4/40 333/185 |

FOREIGN PATENT DOCUMENTS

| | | | |
|---|---|---|---|
| JP | 2002-173368 | A | 6/2002 |
| JP | 2005-175941 | A | 6/2005 |
| JP | A-2007-235630 | | 9/2007 |
| JP | A-2013-45859 | | 3/2013 |

OTHER PUBLICATIONS

Mar. 4, 2015 Office Action issued in Japanese Application No. 2013-160916.

* cited by examiner

DIELECTRIC LINE AND ELECTRONIC COMPONENT

BACKGROUND OF THE INVENTION

1. Field of the Invention

The present invention relates to a dielectric line for propagating an electromagnetic wave of a frequency within the range of 1 to 10 GHz, and an electronic component including the dielectric line.

2. Description of the Related Art

Nowadays, the microwave band, especially a frequency band of 1 to 10 GHz, is often used for near-field communications and mobile communications. It is strongly demanded that communication devices used for such communications be reduced in size and thickness, and accordingly, reductions in size and thickness are also strongly demanded of electronic components used for such communication devices.

Typically, transmission lines having a structure in which a conductor and a dielectric are combined, such as coaxial lines, strip lines, microstrip lines and coplanar lines, are used for transmission of high frequency signals in the 1- to 10-GHz frequency band.

Some electronic components, such as bandpass filters, used for communication devices include resonators. While some of the resonators use a distributed constant line and some others use an inductor and a capacitor, each of the resonators includes a transmission line. The resonators are required to have a high unloaded Q. The unloaded Q of a resonator can be increased by reducing losses in the resonator.

The losses in a transmission line include dielectric loss, conductor loss, and radiation loss. As the frequency of a signal increases, the skin effect becomes significant, and accordingly the conductor loss increases significantly. Most of the loss in a resonator is attributable to the conductor loss. Therefore, to increase the unloaded Q of the resonator, it is effective to reduce the conductor loss. Known techniques for reducing the conductor loss of a resonator to thereby increase its unloaded Q include those disclosed in JP H04-043703A and JP H10-013112A.

The technique disclosed in JP H04-043703A is as follows. In a symmetric strip line resonator, a plurality of strip conductors separated from each other by a dielectric are disposed between a pair of ground conductors so as to be parallel to the ground conductors. The conductor loss in the strip conductors is thereby reduced to increase the unloaded Q of the resonator.

The technique disclosed in JP H10-013112A is as follows. In a resonator having a strip line electrode, a multi-layer electrode including a conductor and a multi-layer section in which dielectric layers and conductor layers are stacked alternately is used as the strip line electrode. The multi-layer section is disposed such that surfaces of the layers constituting the multi-layer section are perpendicular to the plane of a ground electrode. The conductor loss in the strip line electrode is thereby reduced to increase the unloaded Q of the resonator.

On the other hand, a dielectric line is known as a transmission line for propagating electromagnetic waves in a millimeter wave band of about 50 GHz. For example, JP 2007-235630A discloses a transmission line having a configuration in which a high-dielectric constant tape is disposed between two parallel conductor plates arranged parallel to each other and a dielectric filler formed of a low-dielectric constant material is disposed between the high-dielectric constant tape and the two parallel conductor plates. In this transmission line, the electric field of the electromagnetic waves is distributed within the dielectric filler. JP 2007-235630A describes that an actually produced transmission line had low dispersion characteristics in a frequency band of 30 to 60 GHz.

JP 2013-045859A discloses a magnetic dielectric material that has good magnetic properties even in a GHz frequency band.

As described above, the conventional transmission lines for the 1- to 10-GHz frequency band each have a structure in which a conductor and a dielectric are combined. For such transmission lines, it is difficult to reduce conductor loss significantly even if measures are taken, such as increasing the surface area of the conductor as in the techniques disclosed in JP H04-043703A and JP H10-013112A. Accordingly, there is a limit in increasing the unloaded Q of resonators using such transmission lines.

On the other hand, although a dielectric line for propagating electromagnetic waves in a millimeter wave band of about 50 GHz is known as mentioned above, no dielectric line for propagating electromagnetic waves in the 1- to 10-GHz frequency band is known.

The wavelength of an electromagnetic wave is inversely proportional to its frequency. The wavelengths of electromagnetic waves in the 1- to 10-GHz frequency band are about 5 times to about 50 times the wavelengths of electromagnetic waves in a millimeter wave band of about 50 GHz. In general, the conventional dielectric line increases in size as the wavelength of an electromagnetic wave to be propagated therethrough increases. Accordingly, if the conventional dielectric line is used to form an electronic component such as a resonator for the 1- to 10-GHz frequency band, the resulting electronic component is large in size and therefore not practical.

Due to the wavelength-shortening effect of a dielectric, the wavelength of an electromagnetic wave propagating through a dielectric line is shorter than that of an electromagnetic wave propagating through a vacuum. However, the conventional dielectric line cannot provide a significantly high wavelength-shortening effect. By way of example, JP 2007-235630A describes that the dielectric filler has a relative permittivity of, e.g., 4 or less. Given that the relative permittivity is 4, the wavelength-shortening rate is 0.5. Consequently, the use of the conventional dielectric line could not significantly reduce the size of an electronic component by means of the wavelength-shortening effect of the dielectric.

OBJECT AND SUMMARY OF THE INVENTION

It is an object of the present invention to provide a dielectric line configured to propagate one or more electromagnetic waves of one or more frequencies within the range of 1 to 10 GHz, and an electronic component including the dielectric line.

A dielectric line of the present invention includes a line portion and a surrounding dielectric portion. The line portion is formed of a first dielectric having a first relative permittivity. The surrounding dielectric portion is formed of a second dielectric having a second relative permittivity. The line portion is configured to propagate one or more electromagnetic waves of one or more frequencies within the range of 1 to 10 GHz. In a cross section orthogonal to the direction of propagation of the one or more electromagnetic waves through the line portion, the surrounding dielectric portion is present around the line portion. The first relative permittivity is 1,000 or higher. The second relative permittivity is lower than the first relative permittivity. As used herein, "relative permittivity" refers to the real part of complex relative permittivity. The line portion of the present invention is not limited to one that propagates an electromagnetic wave in one direction, but may be one that propagates two electromagnetic waves traveling in opposite directions, such as a progressive wave and a reflected wave.

In the dielectric line of the present invention, the first relative permittivity may be 500,000 or lower. The second relative permittivity may be no higher than one-tenth of the first relative permittivity.

In the dielectric line of the present invention, at least part of the surrounding dielectric portion may have a relative permeability of 1.02 or higher. In this case, the relative permeability of the at least part of the surrounding dielectric portion may be 30 or lower. As used herein, "relative permeability" refers to the real part of complex relative permeability.

In the dielectric line of the present invention, the line portion may have a circular or quadrangular shape in the aforementioned cross section.

An electronic component of the present invention includes the dielectric line of the present invention. The electronic component of the present invention may include a resonator having a resonant frequency within the range of 1 to 10 GHz. The resonator is formed using the dielectric line of the present invention.

In the dielectric line and the electronic component of the present invention, the first dielectric used to form the line portion has the first relative permittivity of 1,000 or higher, and the second dielectric used to form the surrounding dielectric portion has the second relative permittivity lower than the first relative permittivity. This makes it possible for the line portion to propagate one or more electromagnetic waves of one or more frequencies within the range of 1 to 10 GHz. The present invention thus provides a dielectric line configured to propagates one or more electromagnetic waves of one or more frequencies within the range of 1 to 10 GHz, and an electronic component including the dielectric line.

Other and further objects, features and advantages of the invention will appear more fully from the following description.

DETAILED DESCRIPTION OF THE PREFERRED EMBODIMENTS

[First Embodiment]

Figure 1:
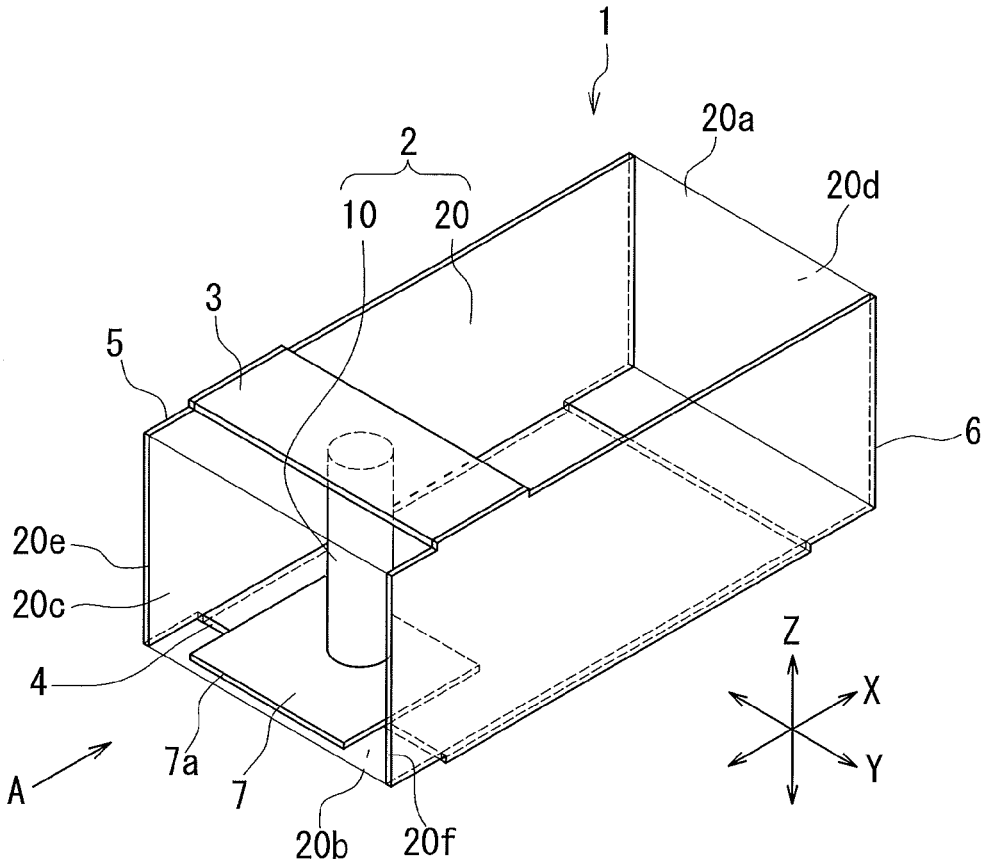
FIG. 1 is a perspective view showing a dielectric line and an electronic component according to a first embodiment of the invention.
Figure 2:
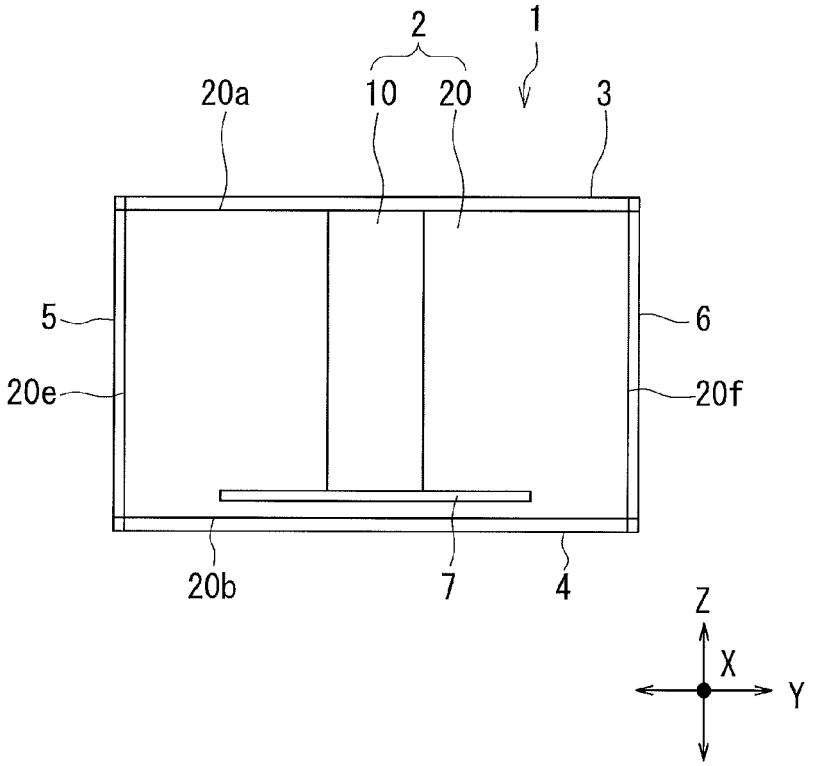
FIG. 2 is a side view of the electronic component as viewed in direction A of FIG. 1.
Figure 3:
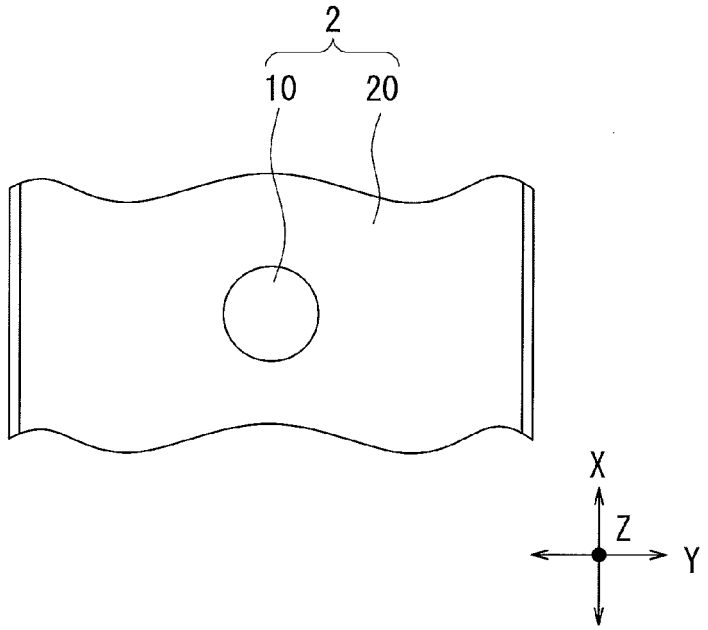
FIG. 3 is a cross-sectional view of the dielectric line shown in FIG. 1.

Preferred embodiments of the present invention will now be described in detail with reference to the drawings. First, reference is made to FIG. 1 to FIG. 3 to describe the structures of a dielectric line and an electronic component according to a first embodiment of the invention. FIG. 1 is a perspective view showing the dielectric line and the electronic component according to the first embodiment. FIG. 2 is a side view of the electronic component as viewed in direction A of FIG. 1. FIG. 3 is a cross-sectional view of the dielectric line shown in FIG. 1.

As shown in FIG. 1 to FIG. 3, the electronic component 1 according to the first embodiment includes the dielectric line 2 according to the first embodiment. The dielectric line 2 includes a line portion 10 and a surrounding dielectric portion 20. The line portion 10 is formed of a first dielectric having a first relative permittivity E1. The surrounding dielectric portion 20 is formed of a second dielectric having a second relative permittivity E2. The line portion 10 propagates one or more electromagnetic waves of one or more frequencies within the range of 1 to 10 GHz. In a cross section orthogonal to the direction of propagation of the one or more electromagnetic waves through the line portion 10, the surrounding dielectric portion 20 is present around the line portion 10. In the first embodiment, in particular, the surrounding dielectric portion 20 is in contact with the entire perimeter of the line portion 10 in the aforementioned cross section. The first relative permittivity E1 is 1,000 or higher. The second relative permittivity E2 is lower than the first relative permittivity E1.

In the first embodiment, the line portion 10 has a cylindrical shape. The direction of propagation of the one or more electromagnetic waves through the line portion 10 is along the central axis of the cylindrical shape. The surrounding dielectric portion 20 has a rectangular-solid shape. In a cross section orthogonal to the direction of propagation of the one or more electromagnetic waves through the line portion 10, the line portion 10 has a circular shape and the surrounding dielectric portion 20 has a rectangular shape. Here, as shown in FIG. 1, a direction parallel to the long sides of the rectangular shape of the surrounding dielectric portion 20 in the aforementioned cross section will be defined as the X direction, and a direction parallel to the short sides of the rectangular shape will be defined as the Y direction. Further, the direction of propagation of the one or more electromagnetic waves through the line portion 10, that is, the direction of the central axis of the cylindrical shape of the line portion 10, will be defined as the Z direction. The X, Y and Z directions are orthogonal to one another. FIG. 3 shows a cross section orthogonal to the Z direction, i.e., the direction of propagation of the one or more electromagnetic waves through the line portion 10.

The surrounding dielectric portion 20 has a top surface 20*a* and a bottom surface 20*b* lying at opposite ends in the Z direction, two side surfaces 20*c* and 20*d* lying at opposite ends in the X direction, and two side surfaces 20*e* and 20*f* lying at opposite ends in the Y direction.

At least part of the surrounding dielectric portion 20 may be formed of a dielectric having magnetism, that is, a magnetic dielectric. In other words, at least part of the surrounding dielectric portion 20 may have a relative permeability higher than 1. In this case, the relative permeability of the at least part of the surrounding dielectric portion 20, a magnetic dielectric, is preferably 1.02 or higher. The magnetic dielectric forming the at least part of the surrounding dielectric portion 20 is at least part of the second dielectric. Therefore, the magnetic dielectric has the second relative permittivity E2 mentioned above.

In the first embodiment, the entire surrounding dielectric portion 20 is formed of a single kind of second dielectric, in particular. Therefore, the entire surrounding dielectric portion 20 has a uniform relative permittivity and a uniform relative permeability. The single kind of second dielectric may be a dielectric having no magnetism, that is, a dielectric with a relative permeability of 1, or a magnetic dielectric.

The electronic component 1 includes conductor layers 3, 4, 5 and 6 located on the top surface 20*a*, the bottom surface 20*b*, the side surface 20*e*, and the side surface 20*f* of the surrounding dielectric portion 20, respectively. The conductor layer 3 is smaller than the top surface 20*a* in length in the X direction. The conductor layer 3 has the same length as the top surface 20*a* in the Y direction. The conductor layer 3 covers only part of the top surface 20*a*. The conductor layer 4 is smaller than the bottom surface 20*b* in length in the X direction. The conductor layer 4 has the same length as the bottom surface 20*b* in the Y direction. The conductor layer 4 covers only part of the bottom surface 20*b*. The conductor layer 5 covers the entire side surface 20*e* and is electrically connected to the conductor layers 3 and 4. The conductor layer 6 covers the entire side surface 20*f* and is electrically connected to the conductor layers 3 and 4. The conductor layers 3, 4, 5 and 6 are connected to the ground.

The electronic component 1 further includes a conductor layer 7 provided inside the surrounding dielectric portion 20 so as to be opposed to and spaced a predetermined distance apart from the conductor layer 4. A portion of the surrounding dielectric portion 20 is interposed between the conductor layers 4 and 7.

A first end of the line portion 10 in the Z direction is connected to the conductor layer 7. The conductor layer 7 has an end 7*a* exposed in the side surface 20*c* of the surrounding dielectric portion 20. A second end of the line portion 10 in the Z direction is connected to the conductor layer 3.

The conductor layers 3, 4, 5, 6 and 7 are each formed of metal such as Ag or Cu. The conductor layer 3 in the electronic component 1 may be replaced with a dielectric layer formed of a dielectric having the first relative permittivity E1.

Figure 4:
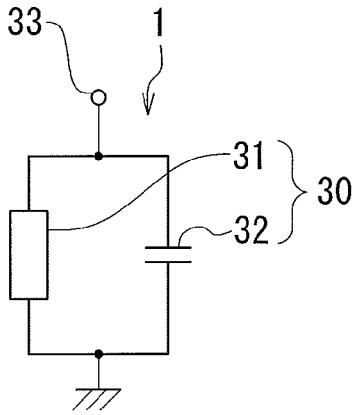
FIG. 4 is a circuit diagram illustrating the circuit configuration of the electronic component shown in FIG. 1.

The circuit configuration of the electronic component 1 according to the first embodiment will now be described with reference to the circuit diagram of FIG. 4. The electronic component 1 according to the first embodiment includes an input/output terminal 33, and a resonator 30 including an inductor 31 and a capacitor 32 connected in parallel. Each of the inductor 31 and the capacitor 32 has a first end electrically connected to the input/output terminal 33, and a second end electrically connected to the ground. The inductor 31 and the capacitor 32 constitute a parallel resonant circuit. The resonator 30 has a resonant frequency within the range of 1 to 10 GHz.

The resonator 30 is formed using the dielectric line 2. More specifically, the inductor 31 constituting part of the resonator 30 is formed by the line portion 10 of the dielectric line 2. The capacitor 32 is composed of the conductor layers 4 and 7 shown in FIG. 1 and the portion of the surrounding dielectric portion 20 interposed between the conductor layers 4 and 7. The input/output terminal 33 is formed by the end 7*a* of the conductor layer 7 shown in FIG. 1. Alternatively, a conductor layer connected to the end 7*a* of the conductor layer 7 may be provided on the side surface 20*c* of the surrounding dielectric portion 20 and may be used as the input/output terminal 33.

The operations of the dielectric line 2 and the electronic component 1 according to the first embodiment will now be described. Electric power of any given frequency within the range of 1 to 10 GHz is supplied to the input/output terminal 33 formed by the end 7*a* of the conductor layer 7. This electric power induces one or more electromagnetic waves in the line portion 10 connected to the conductor layer 7. The line portion 10 propagates one or more electromagnetic waves of one or more frequencies within the range of 1 to 10 GHz. The one or more frequencies of the one or more electromagnetic waves propagated through the line portion 10 include the resonant frequency of the resonator 30. The resonator 30 resonates at a resonant frequency within the range of 1 to 10 GHz. The potential at the input/output terminal 33 is maximum when the frequency of the electric power supplied to the input/output terminal 33 coincides with the resonant frequency, and decreases as the frequency of the electric power supplied to the input/output terminal 33 deviates from the resonant frequency.

In the first embodiment, the first relative permittivity E1 of the first dielectric forming the line portion 10 is 1,000 or higher, and the second relative permittivity E2 of the second dielectric forming the surrounding dielectric portion 20 is lower than the first relative permittivity E1. The value of the first relative permittivity E1, i.e., 1,000 or higher, is significantly higher than the relative permittivity of a dielectric that is used for the conventional dielectric line for propagating electromagnetic waves in a millimeter wave band of about 50 GHz. Setting the first relative permittivity E1 to such a high value makes it possible for the line portion 10 to propagate one or more electromagnetic waves of one or more frequencies within the range of 1 to 10 GHz.

As the first relative permittivity E1 increases, it becomes easier for an electromagnetic wave to propagate through the inside of the line portion 10, and the wavelength-shortening effect of the line portion 10 increases to make it easier to reduce the resonant frequency of the resonator 30. Therefore, theoretically, the first relative permittivity E1 has no upper limit. However, when the first relative permittivity E1 reaches 500,000 or higher, the aforementioned effect becomes almost unchanged. In view of this, it is preferred that the first relative permittivity E1 be 500,000 or lower.

The surrounding dielectric portion 20 formed of the second dielectric having the second relative permittivity E2 lower than the first relative permittivity E1 has the function of concentrating electromagnetic waves into the line portion 10. To allow this function to be performed effectively, it is preferred that the second relative permittivity E2 be no higher than one-tenth of the first relative permittivity E1.

When the second dielectric is a magnetic dielectric, it is possible to make the inductance of the dielectric line 2 higher and thereby make the resonant frequency of the resonator 30 lower than in the case where the second dielectric has no magnetism. Further, as the relative permeability of the magnetic dielectric increases, the inductance of the dielectric line 2 can be further increased, so that the resonance frequency of the resonator 30 can be further reduced. However, as the relative permeability of the magnetic dielectric increases, loss in the magnetic material in the surrounding dielectric portion 20 increases. It is therefore preferred that the relative permeability of the magnetic dielectric forming the surrounding dielectric portion 20 be 30 or lower.

Examples of the dielectric material to form the first dielectric include barium titanate and metal oxide materials containing barium titanate such as barium strontium titanate and barium calcium titanate. The first dielectric having the first relative permittivity E1 of 1,000 or higher is achieved with any of these dielectric materials.

Examples of the dielectric material to form the second dielectric where the second dielectric has no magnetism include resins such as polytetrafluoroethylene, ceramics such as alumina, glass, and composite materials thereof. The second dielectric having the second relative permittivity E2 no higher than one-tenth of the first relative permittivity E1 is achieved with any of these dielectric materials.

Where the second dielectric is a magnetic dielectric, the dielectric material used to form the second dielectric may be any of the above-listed nonmagnetic dielectric materials with magnetic particles dispersed therein. In this case, to reduce magnetic loss in the magnetic particles in the 1- to 10-GHz frequency band, it is preferable to make the diameter of the magnetic particles no greater than the skin depth in the 1- to 10-GHz frequency band, specifically, no greater than 100 nm. It is possible to increase the relative permeability of the magnetic dielectric by forming the magnetic particles into a flattened shape and orienting and dispersing them in the dielectric material. The relative permeability of the magnetic dielectric can be increased also by orienting and dispersing anisotropically shaped aggregates formed by aggregating magnetic particles in the dielectric material, as described in JP 2013-045859A.

As has been described, the first embodiment provides the dielectric line 2 configured to propagate one or more electromagnetic waves of one or more frequencies within the range of 1 to 10 GHz. The first embodiment further provides the electronic component 1 including the dielectric line 2. The electronic component 1 includes a portion configured to propagate one or more electromagnetic waves of one or more frequencies within the range of 1 to 10 GHz. The electronic component 1 according to the first embodiment includes the resonator 30 formed using the dielectric line 2, in particular. The resonator 30 has a resonant frequency within the range of 1 to 10 GHz.

[Second Embodiment]

Figure 5:
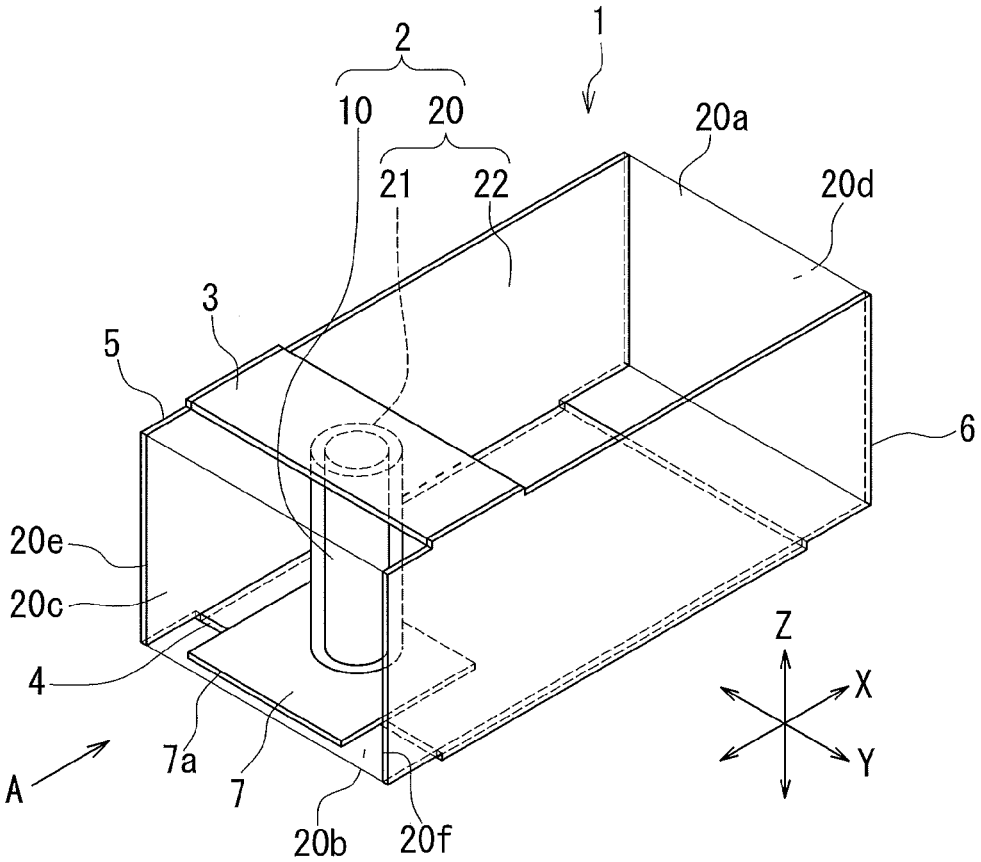
FIG. 5 is a perspective view showing a dielectric line and an electronic component according to a second embodiment of the invention.
Figure 6:
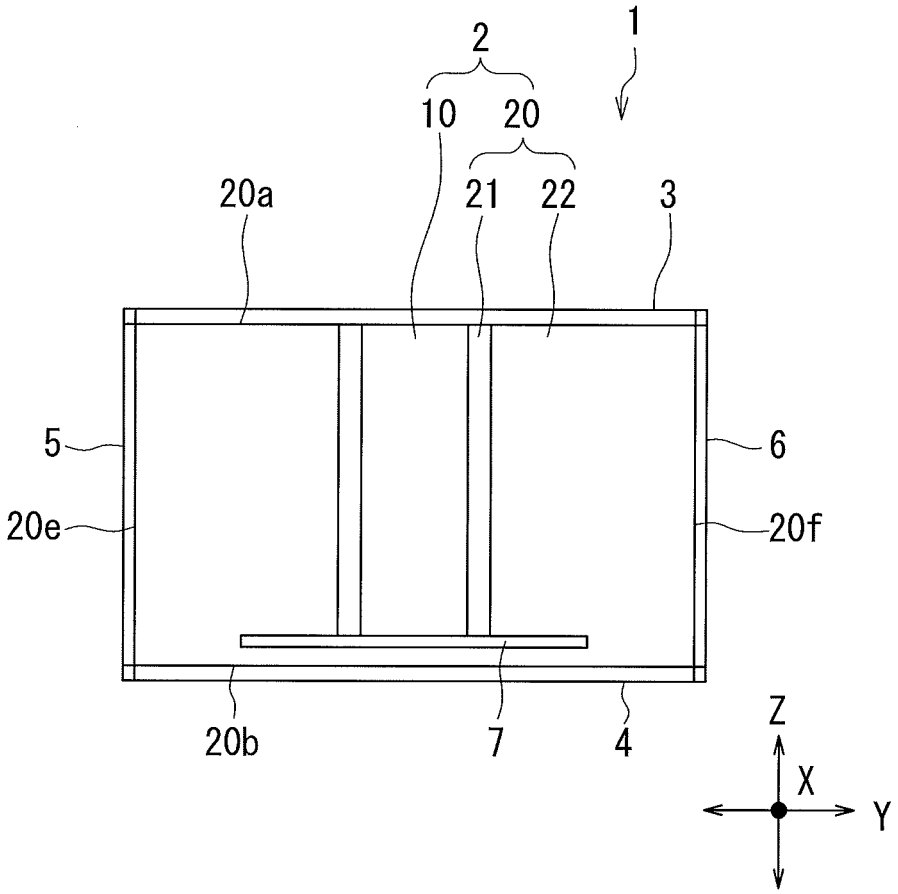
FIG. 6 is a side view of the electronic component as viewed in direction A of FIG. 5.
Figure 7:
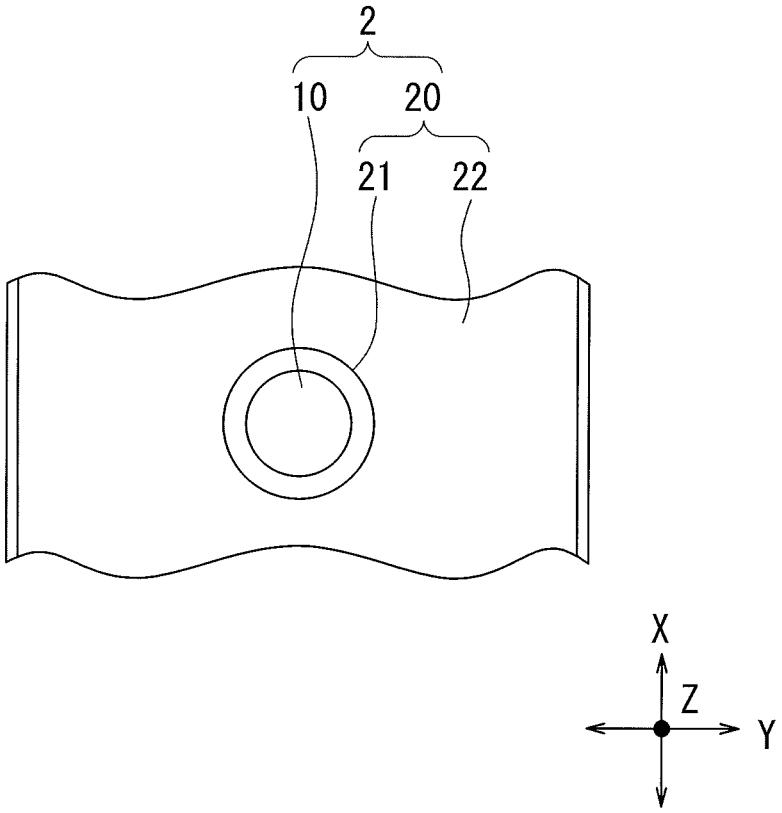
FIG. 7 is a cross-sectional view of the dielectric line shown in FIG. 5.

A dielectric line and an electronic component according to a second embodiment of the invention will now be described with reference to FIG. 5 to FIG. 7. FIG. 5 is a perspective view showing the dielectric line and the electronic component according to the second embodiment. FIG. 6 is a side view of the electronic component as viewed in direction A of FIG. 5. FIG. 7 is a cross-sectional view of the dielectric line shown in FIG. 5.

The dielectric line 2 and the electronic component 1 according to the second embodiment differ from those according to the first embodiment in the configuration of the surrounding dielectric portion 20. Specifically, in the second embodiment, the surrounding dielectric portion 20 includes a magnetic dielectric portion 21 formed of a magnetic dielectric, and a nonmagnetic dielectric portion 22 formed of a dielectric having no magnetism. In a cross section orthogonal to the Z direction or the direction of propagation of the one or more electromagnetic waves through the line portion 10, the magnetic dielectric portion 21 is present around the line portion 10. In the second embodiment, in particular, the magnetic dielectric portion 21 is in contact with the entire perimeter of the line portion 10 in the aforementioned cross section. The magnetic dielectric portion 21 has a cylindrical shape, for example. In the aforementioned cross section, the nonmagnetic dielectric portion 22 is present around the magnetic dielectric portion 21.

The magnetic dielectric portion 21 and the nonmagnetic dielectric portion 22 have the second relative permittivity E2 described in the first embodiment section. The magnetic dielectric portion 21 has a relative permeability higher than 1. The relative permeability of the magnetic dielectric portion 21 is preferably 1.02 or higher. The inclusion of the magnetic dielectric portion 21 in the surrounding dielectric portion 20 makes it possible to increase the inductance of the dielectric line 2 and thereby reduce the resonant frequency of the resonator 30 relative to the case where the entire surrounding dielectric portion 20 has no magnetism. As the relative permeability of the magnetic dielectric portion 21 increases, the inductance of the dielectric line 2 can be further increased, and the resonant frequency of the resonator 30 can thereby be further reduced. However, as the relative permeability of the magnetic dielectric portion 21 increases, loss in the magnetic material in the magnetic dielectric portion 21 increases. It is therefore preferred that the relative permeability of the magnetic dielectric portion 21 be 30 or lower.

Examples of the magnetic dielectric material to form the magnetic dielectric portion 21 are as described in the first embodiment section. Examples of the dielectric material to form the nonmagnetic dielectric portion 22 are the same as the examples of the dielectric material to form the second dielectric where the second dielectric has no magnetism, which have been described in the first embodiment section.

The remainder of configurations of the dielectric line 2 and the electronic component 1 according to the second embodiment are the same as those of the first embodiment. The operations and effects of the dielectric line 2 and the electronic component 1 according to the second embodiment are the same as those of the first embodiment where the second dielectric forming the surrounding dielectric portion 20 is a magnetic dielectric.

[Third Embodiment]

Figure 8:
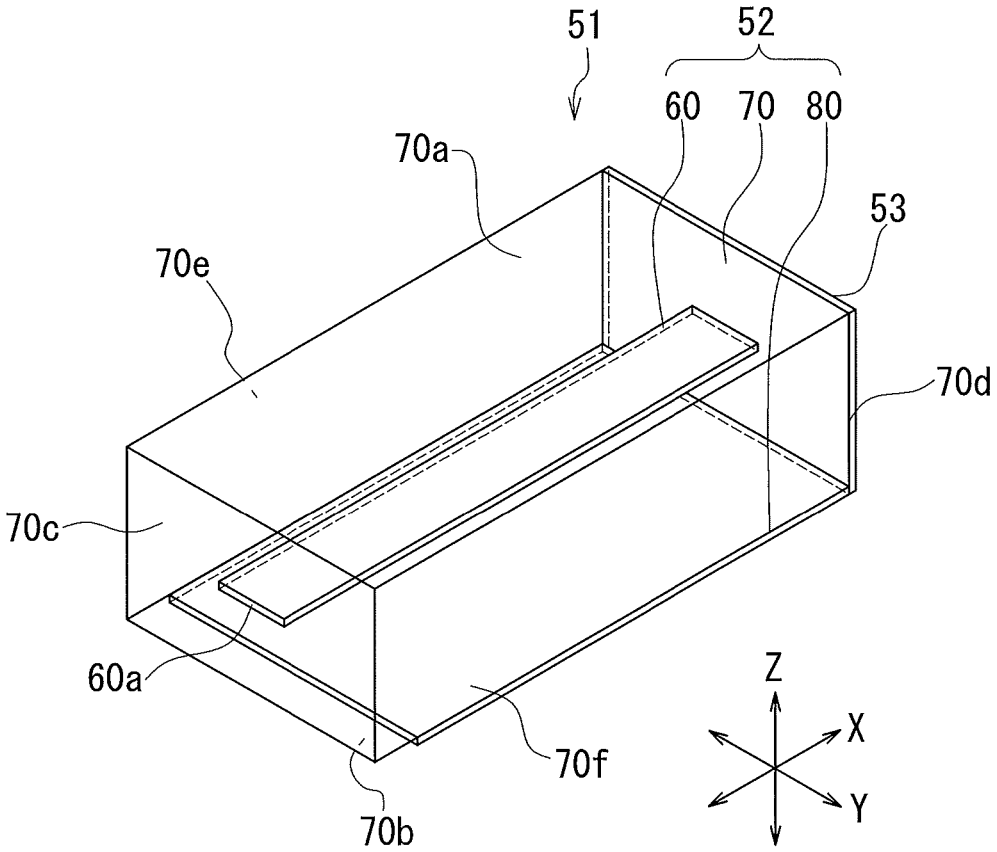
FIG. 8 is a perspective view showing a dielectric line and an electronic component according to a third embodiment of the invention.
Figure 9:
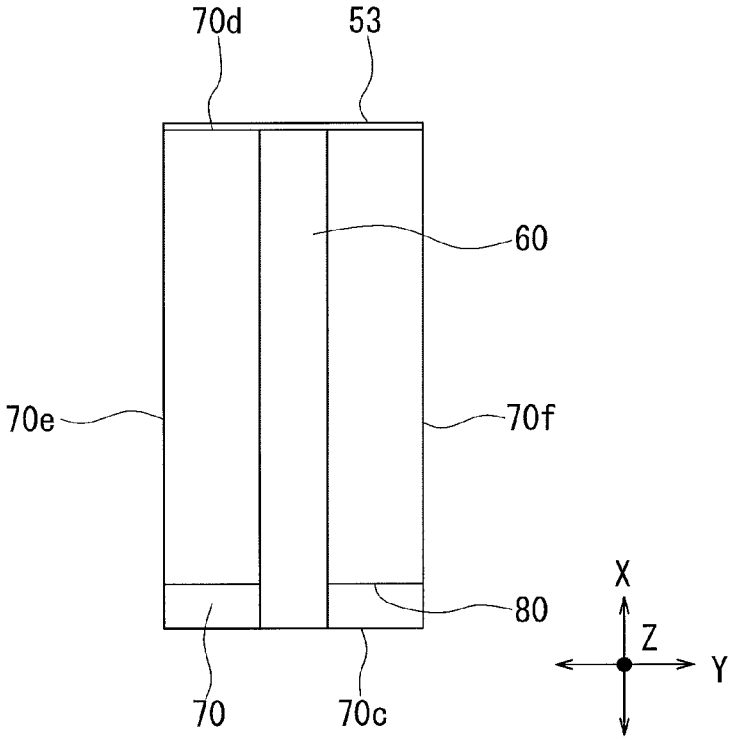
FIG. 9 is a plan view of the electronic component shown in FIG. 8.
Figure 10:
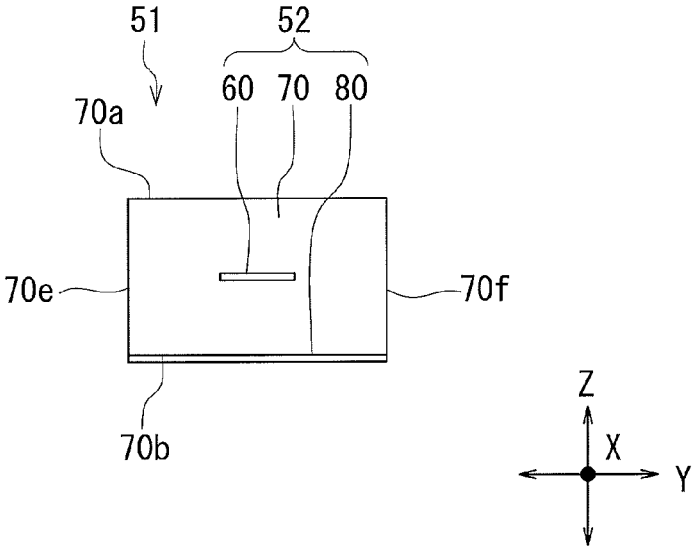
FIG. 10 is a cross-sectional view of the dielectric line shown in FIG. 8.

A dielectric line and an electronic component according to a third embodiment of the invention will now be described with reference to FIG. 8 to FIG. 10. FIG. 8 is a perspective view showing the dielectric line and the electronic component according to the third embodiment. FIG. 9 is a plan view of the electronic component shown in FIG. 8. FIG. 10 is a cross-sectional view of the dielectric line shown in FIG. 8.

As shown in FIG. 8 to FIG. 10, the electronic component 51 according to the third embodiment includes the dielectric line 52 according to the third embodiment. The dielectric line 52 includes a line portion 60 formed of a first dielectric having a first relative permittivity E1, a surrounding dielectric portion 70 formed of a second dielectric having a second relative permittivity E2, and a ground conductor 80. The line portion 60 propagates one or more electromagnetic waves of one or more frequencies within the range of 1 to 10 GHz. In a cross section orthogonal to the direction of propagation of the one or more electromagnetic waves through the line portion 60, the surrounding dielectric portion 70 is present around the line portion 60. In the third embodiment, in particular, the surrounding dielectric portion 70 is in contact with the entire perimeter of the line portion 60 in the aforementioned cross section. As in the first embodiment, the first relative permittivity E1 is 1,000 or higher. The second relative permittivity E2 is lower than the first relative permittivity E1.

The surrounding dielectric portion 70 has a rectangular-solid shape. Here, the X, Y and Z directions are defined as shown in FIG. 8. The X, Y and Z directions are orthogonal to one another. The surrounding dielectric portion 70 has a top surface 70*a* and a bottom surface 70*b* lying at opposite ends in the Z direction, two side surfaces 70*c* and 70*d* lying at opposite ends in the X direction, and two side surfaces 70*e* and 70*f* lying at opposite ends in the Y direction.

In the third embodiment, the line portion 60 is shaped like a plate elongated in the X direction, and embedded in the surrounding dielectric portion 70. The line portion 60 has a top surface facing toward the top surface 70*a* of the surrounding dielectric portion 70, and a bottom surface facing toward the bottom surface 70*b* of the surrounding dielectric portion 70. The one or more electromagnetic waves are propagated through the line portion 60 in the X direction. FIG. 10 shows a cross section orthogonal to the X direction, that is, the direction of propagation of the one or more electromagnetic waves through the line portion 60. In this cross section, the line portion 60 has a quadrangular shape, especially a rectangular shape, and the surrounding dielectric portion 70 also has a rectangular shape.

The ground conductor 80 is disposed on the bottom surface 70*b* of the surrounding dielectric portion 70. The ground conductor 80 extends from the ridge between the side surface 70*d* and the bottom surface 70*b* to a position at a distance from the ridge between the side surface 70*c* and the bottom surface 70*b*.

At least part of the surrounding dielectric portion 70 may be formed of a magnetic dielectric as described in the first embodiment section. In other words, at least part of the surrounding dielectric portion 70 may have a relative permeability higher than 1. In this case, the relative permeability of the at least part of the surrounding dielectric portion 70, a magnetic dielectric, is preferably 1.02 or higher. The magnetic dielectric forming the at least part of the surrounding dielectric portion 70 is at least part of the second dielectric. Therefore, the magnetic dielectric has the second relative permittivity E2 mentioned above.

In the third embodiment, the entire surrounding dielectric portion 70 is formed of a single kind of second dielectric, in particular. Therefore, the entire surrounding dielectric portion 70 has a uniform relative permittivity and a uniform relative permeability. The single kind of second dielectric may be a dielectric having no magnetism, that is, a dielectric with a relative permeability of 1, or a magnetic dielectric.

The electronic component 51 further includes a conductor layer 53 located on the side surface 70*d* of the surrounding dielectric portion 70. The conductor layer 53 covers the entire side surface 70*d* and is electrically connected to the ground conductor 80. The ground conductor 80 and the conductor layer 53 are connected to the ground. The ground conductor 80 and the conductor layer 53 are each formed of metal such as Ag or Cu.

The line portion 60 has an end 60*a*. The end 60*a* is a first end of the line portion 60 in the X direction and exposed in the side surface 70*c* of the surrounding dielectric portion 70. A second end of the line portion 60 opposite to the end 60*a* is connected to the conductor layer 53.

The dielectric line 52 according to the third embodiment has a structure similar to that of a microstrip line. The dielectric line 52 according to the third embodiment differs from a microstrip line in that the line portion 60 formed of the first dielectric is provided instead of a conductor line in a microstrip line.

The electronic component 51 according to the third embodiment includes a resonator having a resonant frequency within the range of 1 to 10 GHz. The resonator is formed using the dielectric line 52. More specifically, the dielectric line 52 according to the third embodiment functions as a distributed constant line, like a microstrip line. The dielectric line 52 forms a quarter-wave resonator having a short-circuited end. This quarter-wave resonator is equivalent to a parallel resonant circuit. Therefore, the equivalent circuit for this quarter-wave resonator or the resonator of the third embodiment is as shown in FIG. 4. Hereinafter, the resonator of the third embodiment will be denoted by reference numeral 30 as in the first embodiment. In the third embodiment, the end 60*a* of the line portion 60 forms an open end of the quarter-wave resonator and the input/output terminal 33 shown in FIG. 4. Alternatively, a conductor layer connected to the end 60*a* of the line portion 60 may be provided on the side surface 70*c* of the surrounding dielectric portion 70 and may be used as the input/output terminal 33. As a further alternative, a through hole having a bottom end connected to a part of the line portion 60 near the end 60*a* and a top end exposed in the top surface 70*a* of the surrounding dielectric portion 70 may be provided inside the surrounding dielectric portion 70, and the top end of this through hole may be used as the input/output terminal 33. The second end of the line portion 60 opposite to the end 60*a* is connected to the conductor layer 53 and forms the short-circuited end of the quarter-wave resonator.

The respective preferred ranges of the first relative permittivity E1, the second relative permittivity E2, and the relative permeability of the magnetic dielectric, and examples of materials of the first dielectric, the second dielectric and the magnetic dielectric in the third embodiment are the same as those in the first embodiment.

The operations of the dielectric line 52 and the electronic component 51 according to the third embodiment will now be described. Electric power of any given frequency within the range of 1 to 10 GHz is supplied to the input/output terminal 33 formed by the end 60*a* of the line portion 60. This electric power induces one or more electromagnetic waves in the line portion 60. The line portion 60 propagates one or more electromagnetic waves of one or more frequencies within the range of 1 to 10 GHz. The one or more frequencies of the one or more electromagnetic waves propagated through the line portion 10 include the resonant frequency of the resonator 30. The resonator 30 resonates at a resonant frequency within the range of 1 to 10 GHz. The potential at the input/output terminal 33 is maximum when the frequency of the electric power supplied to the input/output terminal 33 coincides with the resonant frequency, and decreases as the frequency of the electric power supplied to the input/output terminal 33 deviates from the resonant frequency.

When the second dielectric is a magnetic dielectric, it is possible to make the inductance of the dielectric line 52 higher and thereby make the resonant frequency of the resonator 30 lower than in the case where the second dielectric has no magnetism. The remainder of functions and effects of the dielectric line 52 and the electronic component 51 according to the third embodiment are similar to those in the first embodiment.

[Fourth Embodiment]

Figure 11:
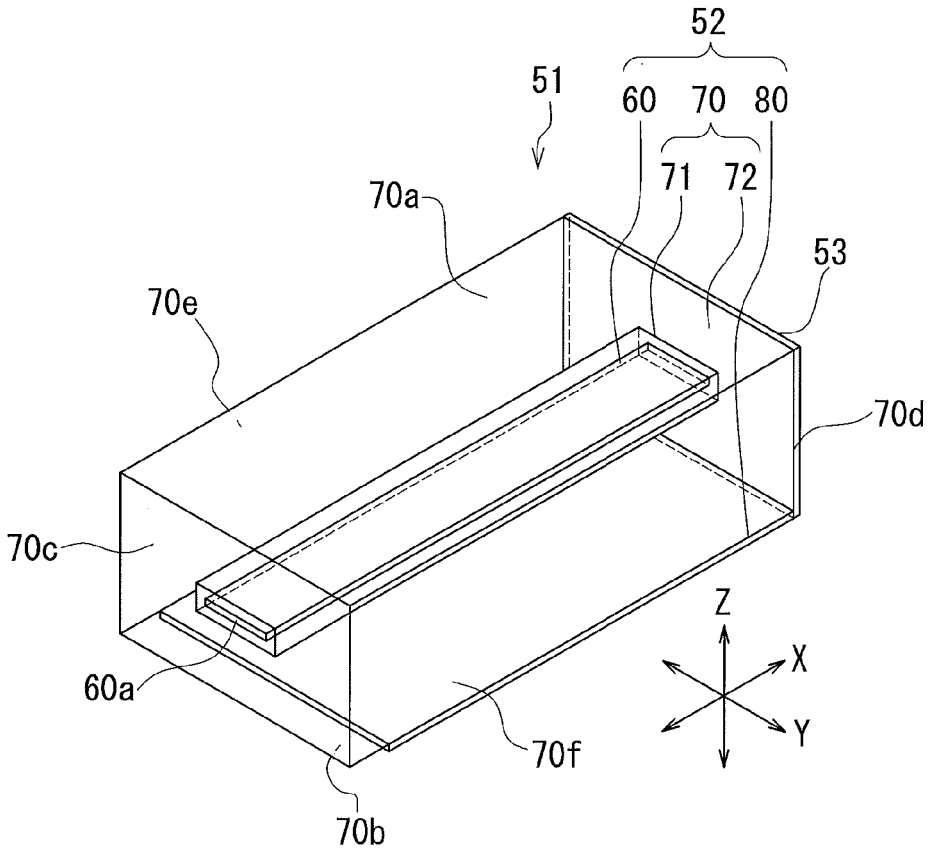
FIG. 11 is a perspective view showing a dielectric line and an electronic component according to a fourth embodiment of the invention.
Figure 12:
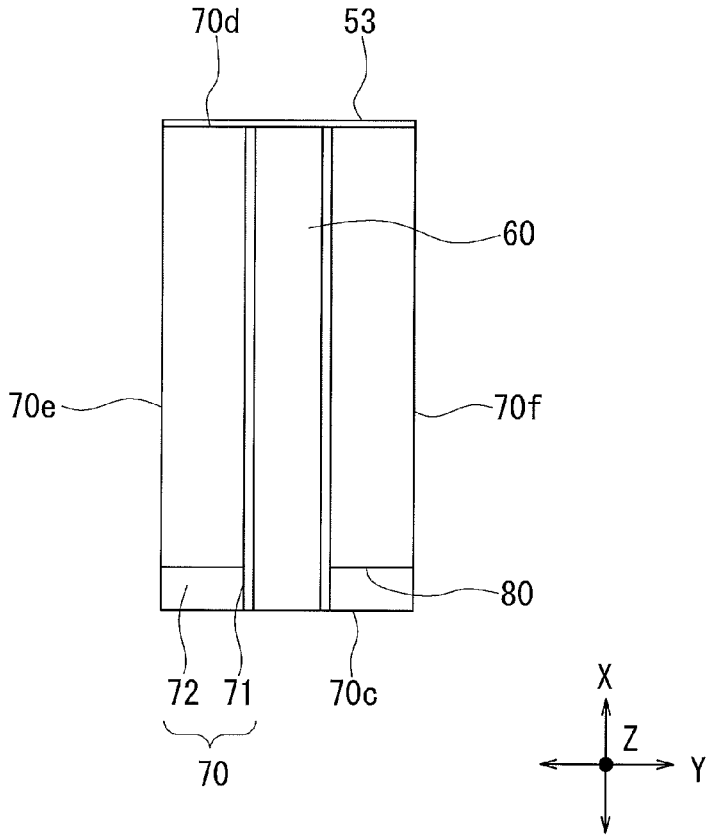
FIG. 12 is a plan view of the electronic component shown in FIG. 11.
Figure 13:
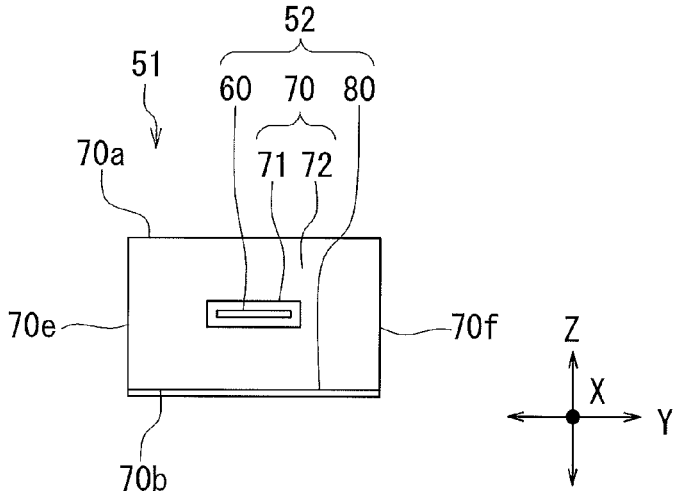
FIG. 13 is a cross-sectional view of the dielectric line shown in FIG. 11.

A dielectric line and an electronic component according to a fourth embodiment of the invention will now be described with reference to FIG. 11 to FIG. 13. FIG. 11 is a perspective view showing the dielectric line and the electronic component according to the fourth embodiment. FIG. 12 is a plan view of the electronic component shown in FIG. 11. FIG. 13 is a cross-sectional view of the dielectric line shown in FIG. 11.

The dielectric line 52 and the electronic component 51 according to the fourth embodiment differ from those according to the third embodiment in the configuration of the surrounding dielectric portion 70. Specifically, in the fourth embodiment, the surrounding dielectric portion 70 includes a magnetic dielectric portion 71 formed of a magnetic dielectric, and a nonmagnetic dielectric portion 72 formed of a dielectric having no magnetism. In a cross section orthogonal to the X direction or the direction of propagation of the one or more electromagnetic waves through the line portion 60, the magnetic dielectric portion 71 is present around the line portion 60. In the fourth embodiment, in particular, the magnetic dielectric portion 71 is in contact with the entire perimeter of the line portion 60 in the aforementioned cross section. The outer edge of the magnetic dielectric portion 71 in the aforementioned cross section has a rectangular shape, for example. The nonmagnetic dielectric portion 72 is present around the magnetic dielectric portion 71 in the aforementioned cross section.

The magnetic dielectric portion 71 and the nonmagnetic dielectric portion 72 have the second relative permittivity E2 described in the first embodiment section. The magnetic dielectric portion 71 has a relative permeability higher than 1. The relative permeability of the magnetic dielectric portion 71 is preferably 1.02 or higher. Further, the relative permeability of the magnetic dielectric portion 71 is preferably 30 or lower. Examples of the magnetic dielectric material to form the magnetic dielectric portion 71 are as described in the first embodiment section. Examples of the dielectric material to form the nonmagnetic dielectric portion 72 are the same as the examples of the dielectric material to form the second dielectric where the second dielectric has no magnetism, which have been described in the first embodiment section.

The remainder of configurations of the dielectric line 52 and the electronic component 51 according to the fourth embodiment are the same as those of the third embodiment. The operations and effects of the dielectric line 52 and the electronic component 51 according to the fourth embodiment are the same as those of the third embodiment where the second dielectric forming the surrounding dielectric portion 70 is a magnetic dielectric.

A first to a fourth simulation were conducted on the dielectric line of the present invention. The results of the simulations will now be described.

[First Simulation]

The first simulation will be described first. In the first simulation, a first electronic component and a second electronic component each using the dielectric line of the present invention were designed. The first electronic component includes a first resonator having a resonant frequency of 1 GHz. The second electronic component includes a second resonator having a resonant frequency of 10 GHz.

Figure 14:
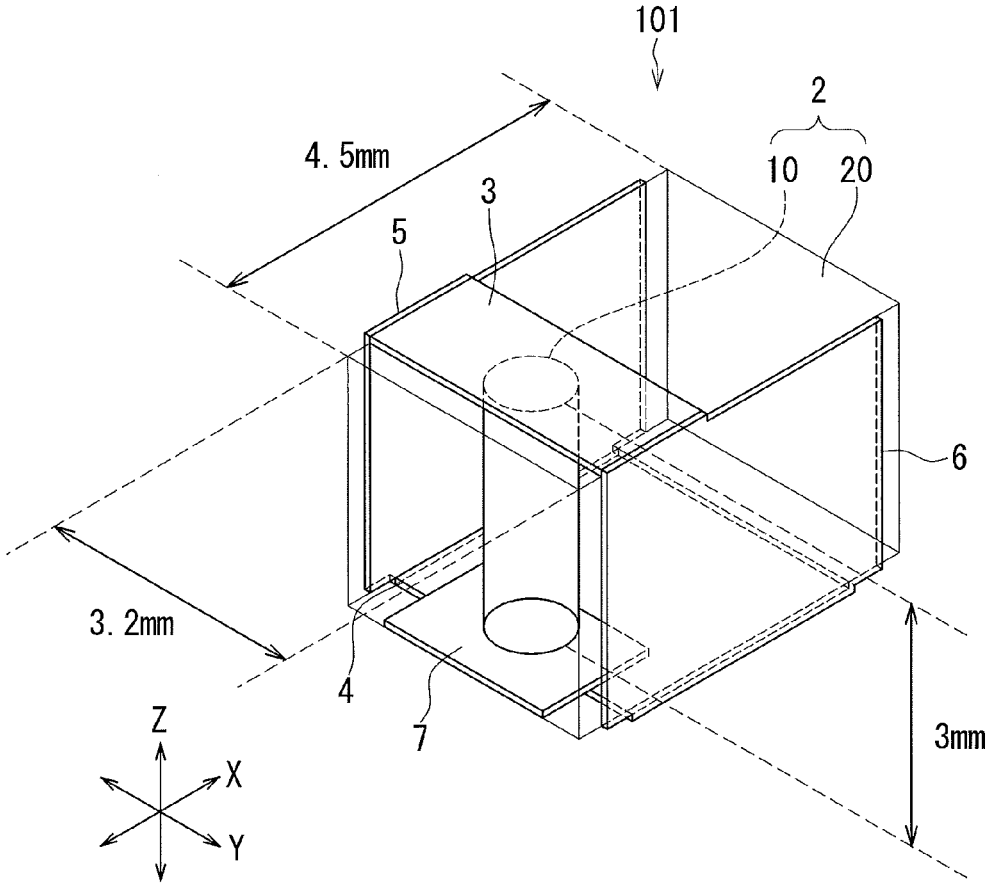
FIG. 14 is a perspective view of a first electronic component which was designed by a first simulation.
Figure 15:
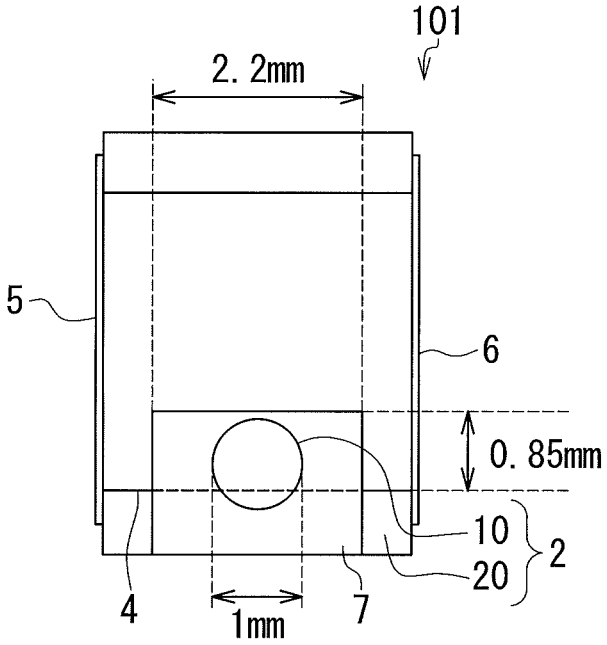
FIG. 15 is a plan view of the first electronic component shown in FIG. 14.

First, the first electronic component 101 will be described with reference to FIG. 14 and FIG. 15. FIG. 14 is a perspective view of the first electronic component 101. FIG. 15 is a plan view of the first electronic component 101. The first electronic component 101 has basically the same configuration as the electronic component 1 according to the first embodiment shown in FIG. 1. The conductor layer 3 is omitted from FIG. 15.

Dimensions of various parts of the first electronic component 101 are as follows. As shown in FIG. 14, the line portion 10 is 3 mm long in the Z direction. The surrounding dielectric portion 20 is 4.5 mm long in the X direction and 3.2 mm long in the Y direction. As shown in FIG. 15, the line portion 10 has a diameter of 1 mm in a cross section orthogonal to the Z direction. When viewed in the Z direction, the region where the conductor layer 4 and the conductor layer 7 overlap each other has a rectangular shape. This region is 0.85 mm long in the X direction and 2.2 mm long in the Y direction. The conductor layers 4 and 7 are at a distance of 0.03 mm from each other. Because the thickness of the conductor layer 7 and the distance between the conductor layers 4 and 7 are sufficiently smaller than the length of the line portion 10 in the Z direction, the length of the surrounding dielectric portion 20 in the Z direction is approximately 3 mm.

In the first electronic component 101, the first relative permittivity E1 of the first dielectric forming the line portion 10 is 1,000. The first dielectric has a dielectric loss tangent of 0.001. The second relative permittivity E2 of the second dielectric forming the surrounding dielectric portion 20 is 10. The second dielectric has a relative permeability of 20. The capacitor 32 (see FIG. 4) composed of the conductor layers 4 and 7 and the portion of the surrounding dielectric portion 20 interposed therebetween has a capacitance of 5.792 pF. The first resonator is composed of the inductor 31 and the capacitor 32. The inductor 31 is formed by the line portion 10.

Figure 16:
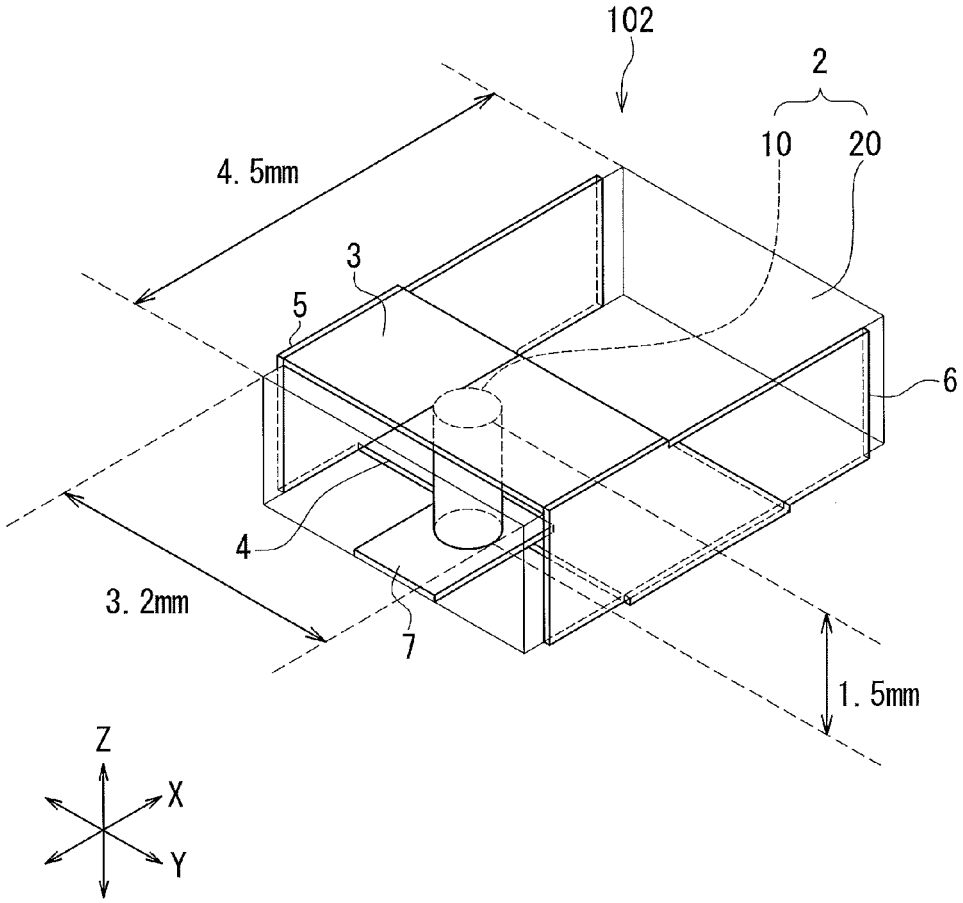
FIG. 16 is a perspective view of a second electronic component which was designed by the first simulation.
Figure 17:
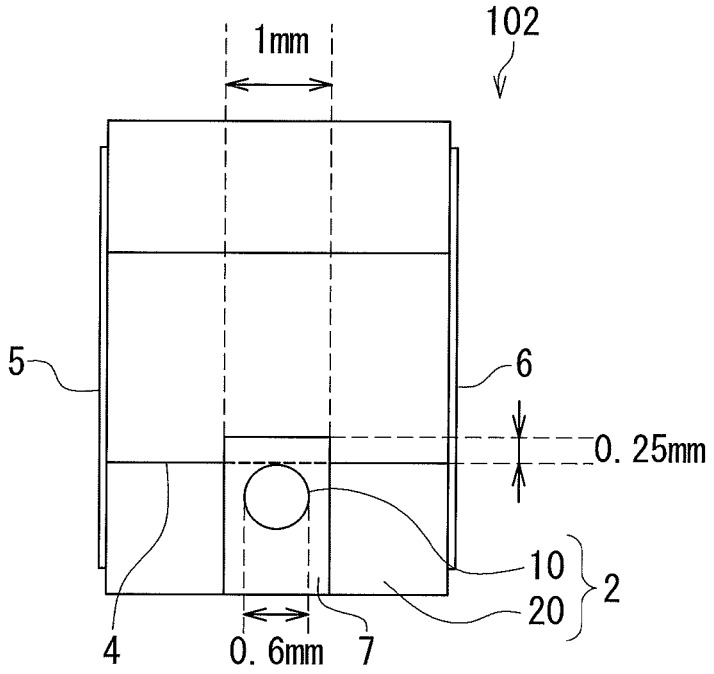
FIG. 17 is a plan view of the second electronic component shown in FIG. 16.

Next, the second electronic component 102 will be described with reference to FIG. 16 and FIG. 17. FIG. 16 is a perspective view of the second electronic component 102. FIG. 17 is a plan view of the second electronic component 102. The second electronic component 102 has basically the same configuration as the electronic component 1 according to the first embodiment shown in FIG. 1. The conductor layer 3 is omitted from FIG. 17.

Dimensions of various parts of the second electronic component 102 are as follows. As shown in FIG. 16, the line portion 10 is 1.5 mm long in the Z direction. The surrounding dielectric portion 20 is 4.5 mm long in the X direction and 3.2 mm long in the Y direction. As shown in FIG. 17, the line portion 10 has a diameter of 0.6 mm in a cross section orthogonal to the Z direction. When viewed in the Z direction, the region where the conductor layer 4 and the conductor layer 7 overlap each other has a rectangular shape.

This region is 0.25 mm long in the X direction and 1 mm long in the Y direction. The conductor layers 4 and 7 are at a distance of 0.03 mm from each other. Because the thickness of the conductor layer 7 and the distance between the conductor layers 4 and 7 are sufficiently smaller than the length of the line portion 10 in the Z direction, the length of the surrounding dielectric portion 20 in the Z direction is approximately 1.5 mm.

In the second electronic component 102, the first relative permittivity E1 of the first dielectric forming the line portion 10 is 1,000. The first dielectric has a dielectric loss tangent of 0.001. The second relative permittivity E2 of the second dielectric forming the surrounding dielectric portion 20 is 10. The second dielectric has a relative permeability of 1. The capacitor 32 (see FIG. 4) composed of the conductor layers 4 and 7 and the portion of the surrounding dielectric portion 20 interposed therebetween has a capacitance of 0.851 pF. The second resonator is composed of the inductor 31 and the capacitor 32. The inductor 31 is formed by the line portion 10.

Figure 18:
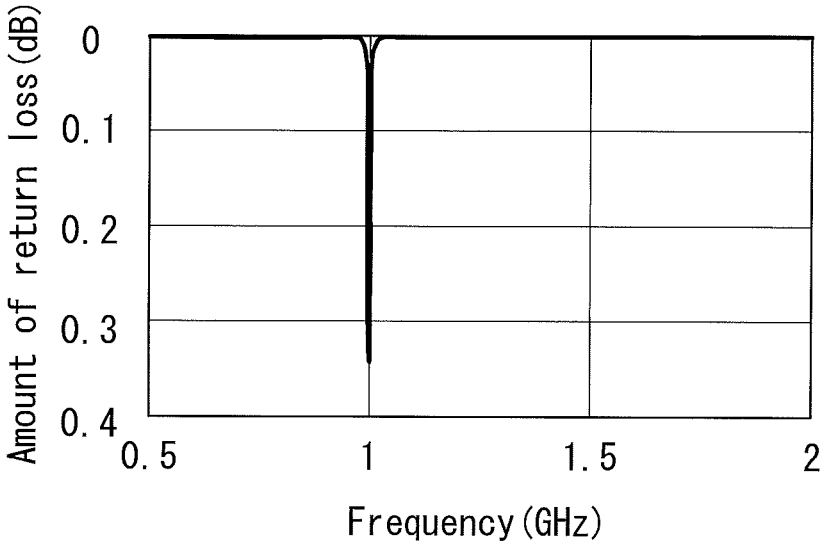
FIG. 18 is a characteristic diagram illustrating the return loss characteristic of the first electronic component shown in FIG. 14.

FIG. 18 illustrates the return loss characteristic of the first electronic component 101. In FIG. 18, the horizontal axis represents frequency, and the vertical axis represents the amount of return loss. In the return loss characteristic of the first electronic component 101, the amount of return loss peaks at 1 GHz as shown in FIG. 18. This indicates that the first resonator of the first electronic component 101 has a resonant frequency of 1 GHz. This further indicates that the line portion 10 of the first electronic component 101 is capable of propagating at least an electromagnetic wave of a frequency of 1 GHz.

Figure 19:
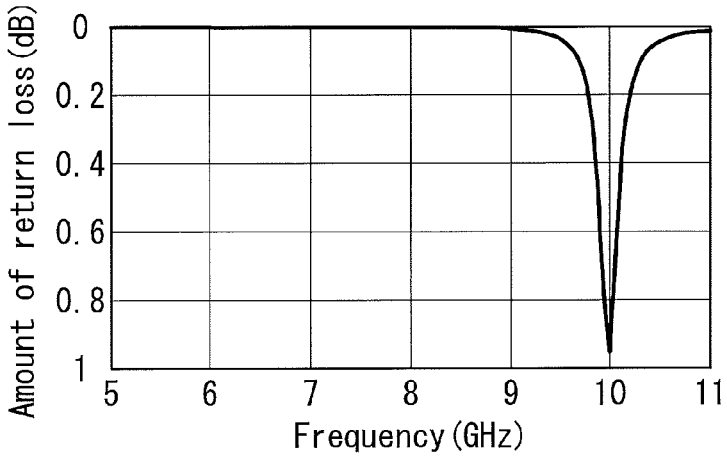
FIG. 19 is a characteristic diagram illustrating the return loss characteristic of the second electronic component shown in FIG. 16.

FIG. 19 illustrates the return loss characteristic of the second electronic component 102. In FIG. 19, the horizontal axis represents frequency, and the vertical axis represents the amount of return loss. In the return loss characteristic of the second electronic component 102, the amount of return loss peaks at 10 GHz as shown in FIG. 19. This indicates that the second resonator of the second electronic component 102 has a resonant frequency of 10 GHz. This further indicates that the line portion 10 of the second electronic component 102 is capable of propagating at least an electromagnetic wave of a frequency of 10 GHz.

As is clear from the results of the first simulation, a line portion 10 that propagates one or more electromagnetic waves of one or more frequencies between 1 GHz and 10 GHz inclusive, and an electronic component provided with a resonator that includes the line portion 10 and has a resonant frequency between 1 GHz and 10 GHz inclusive can be realized by adjusting the dimensions of various parts of the electronic component, the first relative permittivity E1, the second relative permittivity E2, and the relative permeability of the second dielectric.

In the first electronic component 101 and the second electronic component 102, the first relative permittivity E1 of the first dielectric forming the line portion 10 is 1,000. As the first relative permittivity E1 increases, it becomes easier for an electromagnetic wave to propagate through the inside of the line portion 10. It is therefore clear that if the first relative permittivity E1 is 1,000 or higher, it is possible to realize a line portion 10 that propagates one or more electromagnetic waves of one or more frequencies within the range of 1 to 10 GHz, and also an electronic component provided with a resonator that includes the line portion 10 and has a resonant frequency within the range of 1 to 10 GHz.

[Second Simulation]

The second simulation will now be described. The second simulation examined the relationships among the shape of the line portion 10, the first relative permittivity E1, the second relative permittivity E2, and the resonant frequency of the resonator 30 for the electronic component 1 according to the first embodiment. The second simulation used five models A to E of the electronic component 1 that were different in the second relative permittivity E2 and the shape of the line portion 10. Table 1 below shows the second relative permittivity E2, the diameter D of the line portion 10 in a cross section orthogonal to the Z direction, and the length L of the line portion 10 in the Z direction for each of the models A to E. The relative permeability of the first dielectric and that of the second dielectric are both 1.

TABLE 1

| Model | A | B | C | D | E |
|---|---|---|---|---|---|
| E2 | 400 | 100 | 100 | 75 | 7 |
| D (μm) | 100 | 150 | 200 | 300 | 500 |
| L (μm) | 400 | 600 | 800 | 1100 | 1600 |

Figure 20:
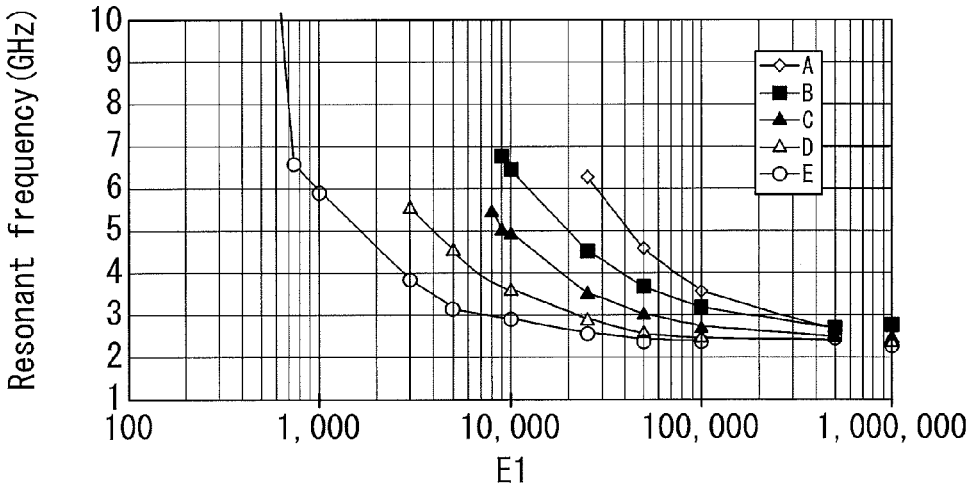
FIG. 20 is a characteristic diagram illustrating the results of a second simulation.

In the second simulation, the relationship between the first relative permittivity E1 and the resonant frequency of the resonator 30 was examined for each of the models A to E. The capacitance of the capacitor 32 was set to 3 pF. The results of the second simulation are shown in FIG. 20. In FIG. 20, the horizontal axis represents the first relative permittivity E1, and the vertical axis represents the resonant frequency.

The results shown in FIG. 20 indicate that the resonant frequency becomes lower as the line portion 10 increases in size and as the first relative permittivity E1 increases. However, when the first relative permittivity E1 reaches 500,000 or higher, the resonant frequency becomes almost constant regardless of the size of the line portion 10. It is thus preferred that the first relative permittivity E1 be 500,000 or lower.

[Third Simulation]

The third simulation will now be described. The third simulation examined the relationships among the first relative permittivity E1, the relative permeability of the magnetic dielectric portion 21, the resonant frequency of the resonator 30, and the unloaded Q of the resonator 30 for the electronic component 1 according to the second embodiment. The third simulation used a model of the electronic component 1 in which the line portion 10 was 150 μm in diameter in a cross section orthogonal to the Z direction, the magnetic dielectric portion 21 was 25 μm thick in the cross section orthogonal to the Z direction, the perimeter of the magnetic dielectric portion 21 was 200 μm in diameter in the cross section orthogonal to the Z direction, the line portion 10 was 460 μm long in the Z direction, and the capacitor 32 had a capacitance of 3 pF. The second relative permittivity E2 was 75. The dielectric loss tangent of the first dielectric and that of the magnetic dielectric portion 21 were both 0.001. Table 2 below shows the results of the third simulation. Here, the relative permeability of the magnetic dielectric portion 21 will be denoted by symbol μ. For the sake of convenience, the case where the entire surrounding dielectric portion 20 has no magnetism is represented as where the relative permeability p of the magnetic dielectric portion 21 is 1.0.

TABLE 2

| First relative permittivity E1 | Relative permeability μ of magnetic dielectric portion 21 | Resonant frequency (GHz) | Unloaded Q |
|---|---|---|---|
| 50,000 | 3.0 | 4.53 | 244.8 |
| 50,000 | 2.0 | 4.75 | 237.5 |
| 50,000 | 1.5 | 4.87 | 237.7 |
| 50,000 | 1.0 | 4.99 | 237.6 |
| 10,000 | 3.0 | 6.51 | 271.3 |
| 10,000 | 2.0 | 6.82 | 257.3 |
| 10,000 | 1.5 | 6.99 | 258.8 |
| 5,000 | 50.00 | 3.63 | 213.4 |
| 5,000 | 30.00 | 4.49 | 187.1 |
| 5,000 | 10.00 | 6.52 | 167.2 |
| 5,000 | 5.00 | 7.64 | 152.8 |
| 5,000 | 3.00 | 8.26 | 144.9 |
| 5,000 | 2.00 | 8.61 | 141.2 |
| 5,000 | 1.50 | 8.79 | 137.4 |
| 5,000 | 1.10 | 8.98 | 134.0 |
| 5,000 | 1.05 | 9.00 | 136.4 |
| 5,000 | 1.02 | 9.01 | 136.6 |

In the third simulation, the resonant frequency and unloaded Q of the resonator were also determined for a model of a comparative example. In the model of the comparative example, the line portion 10 of the model of the electronic component 1 used in the third simulation was replaced with a conductor line portion formed of Ag and having the same shape as the line portion 10, and the relative permeability of the magnetic dielectric portion 21 was set to 1.0. For the model of the comparative example, the resonant frequency of the resonator was 4.52 GHz, and the unloaded Q of the resonator was 130.9.

For the model of the electronic component 1 used in the third simulation, a resonant frequency within the range of 1 to 10 GHz and an unloaded Q higher than that of the model of the comparative example were obtained when the first relative permittivity E1 and the relative permeability μ of the magnetic dielectric portion 21 met any of the conditions shown in Table 2.

Figure 21:
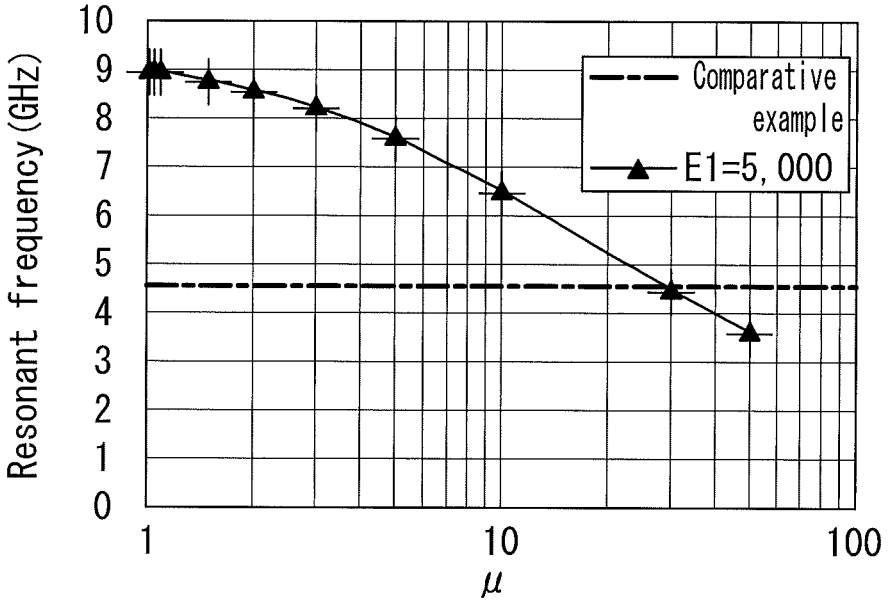
FIG. 21 is a characteristic diagram illustrating the results of a third simulation.

FIG. 21 shows part of the results of the third simulation, specifically the relationship between the relative permeability μ of the magnetic dielectric portion 21 and the resonant frequency of the resonator 30 when the first relative permittivity E1 is 5,000. In FIG. 21, the horizontal axis represents the relative permeability μ of the magnetic dielectric portion 21, and the vertical axis represents the resonant frequency of the resonator 30. In FIG. 21, the relationship between the relative permeability μ of the magnetic dielectric portion 21 and the resonant frequency when the first relative permittivity E1 is 5,000 is indicated by a plurality of filled triangles and a curve connecting them. In FIG. 21, the resonant frequency of the resonator in the model of the comparative example is indicated by alternate long and short dashed lines.

For the model of the electronic component 1 used in the third simulation, as can be seen from Table 2 and FIG. 21, a resonant frequency of 10 GHz or lower is obtained when the relative permeability μ of the magnetic dielectric portion 21 is 1.02 or higher with the first relative permittivity E1 being 5,000. Further, as can be seen from Table 2 and FIG. 21, the resonant frequency decreases as the relative permeability μ of the magnetic dielectric portion 21 increases. Therefore, the higher the relative permeability μ of the magnetic dielectric portion 21, the easier it becomes to realize an electronic component 1 provided with a resonator 30 having a resonant frequency within the range of 1 to 10 GHz. However, as the relative permeability μ of the magnetic dielectric portion 21 increases, loss in the magnetic material in the magnetic dielectric portion 21 increases. It is sufficient that the relative permeability μ of the magnetic dielectric portion 21 is about 30 at the maximum.

[Fourth Simulation]

The fourth simulation will now be described. The fourth simulation examined magnetic field strengths in the vicinity of the line portion 10 in the dielectric line 2 according to each of the first and second embodiments. FIG. 22A to FIG. 22E show five models of the dielectric line 2 with different conditions. Of the five models, four shown in FIG. 22A to FIG. 22D are models of the dielectric line 2 according to the first embodiment. In each of the four models shown in FIG. 22A to FIG. 22D, the line portion 10 was 150 μm in diameter in a cross section orthogonal to the Z direction, the second relative permittivity E2 was 7, and the relative permeability of the surrounding dielectric portion 20 was 1. For the models shown in FIG. 22A, FIG. 22B, FIG. 22C and FIG. 22D, the first relative permittivity E1 was set to 1,000, 2,000, 5,000, and 10,000, respectively. The dielectric loss tangent of the first dielectric was 0.001 in each of the models shown in FIG. 22A to FIG. 22D.

Figure 22A:
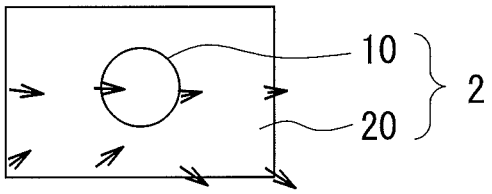
FIG. 22A to FIG. 22E are explanatory diagrams illustrating the results of a fourth simulation.
Figure 22B:
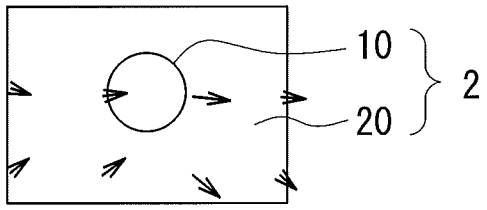
Figure 22C:
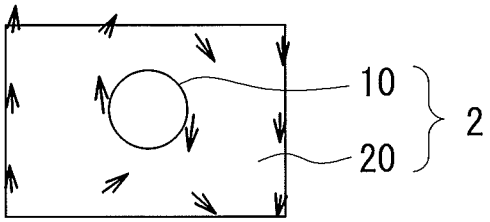
Figure 22D:
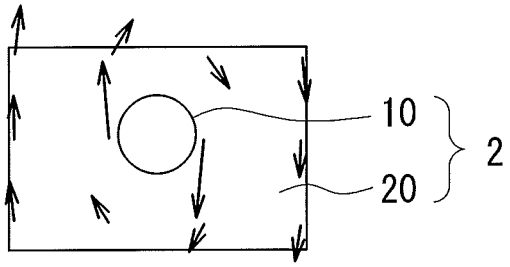
Figure 22E:
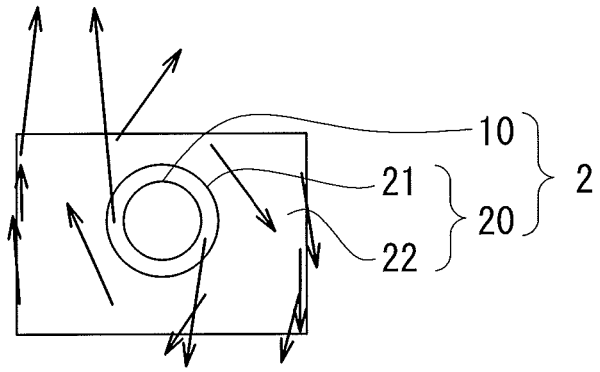

The model shown in FIG. 22E is a model of the dielectric line 2 according to the second embodiment. In the model shown in FIG. 22E, the line portion 10 was 150 μm in diameter in a cross section orthogonal to the Z direction, the magnetic dielectric portion 21 was 25 μm thick in the cross section orthogonal to the Z direction, and the perimeter of the magnetic dielectric portion 21 was 200 μm in diameter in the cross section orthogonal to the Z direction. Further, in the model shown FIG. 22E, the first relative permittivity E1 was 10,000, the dielectric loss tangent of the first dielectric was 0.001, the second relative permittivity E2 was 7, and the relative permeability μ of the magnetic dielectric portion 21 was 5.

In FIG. 22A to FIG. 22E, magnetic field strengths at 12 points in the vicinity of the line portion 10 are shown by arrows. The longer an arrow is, the higher the magnetic field strength is. As shown in FIG. 22A to FIG. 22D, the magnetic field strengths in the vicinity of the line portion 10 increase as the first relative permittivity E1 increases. This indicates that the higher the first relative permittivity E1 is, the higher the inductance of the dielectric line 2 can be, so that the lower the resonant frequency of the resonator 30 can be.

Further, it can be seen from FIG. 22D and FIG. 22E that the inclusion of the magnetic dielectric portion 21 in the surrounding dielectric portion 20 increases the magnetic field strengths in the vicinity of the line portion 10 relative to the case where the entire surrounding dielectric portion 20 has no magnetism. This indicates that when at least part of the surrounding dielectric portion 20 has magnetism, it is possible to increase the inductance of the dielectric line 2 and to thereby reduce the resonant frequency of the resonator 30.

[Fifth Embodiment]

Figure 23:
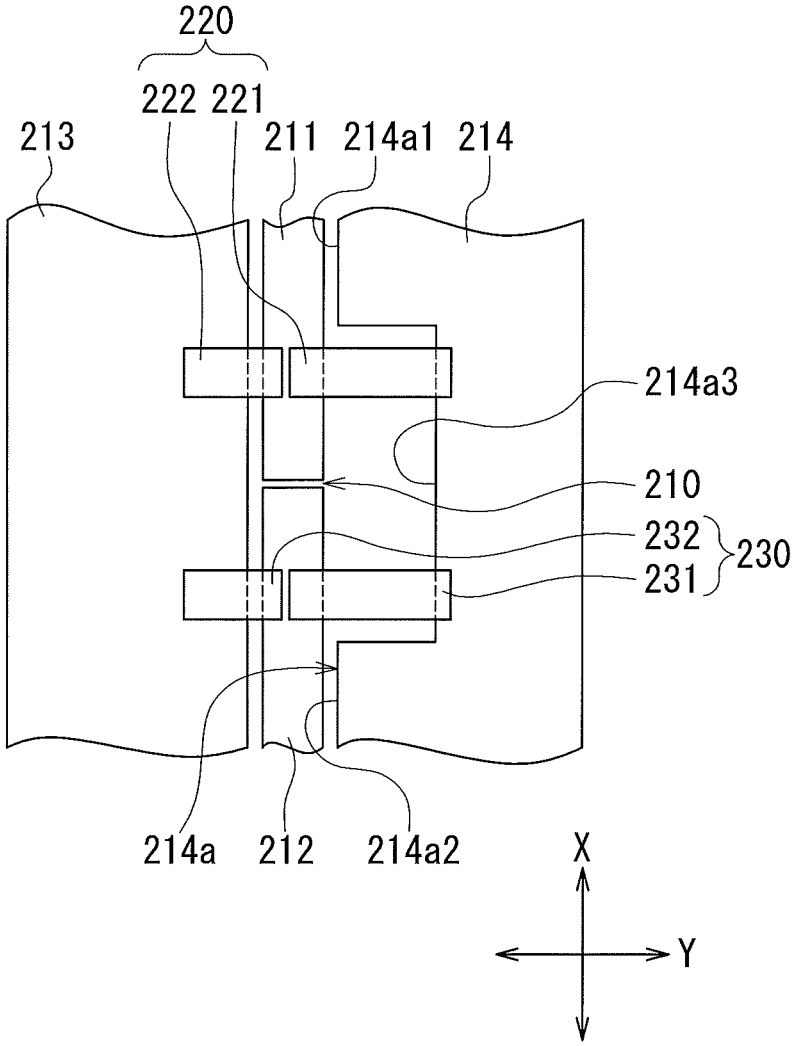
FIG. 23 is a plan view of an electronic component according to a fifth embodiment of the invention.
Figure 24:
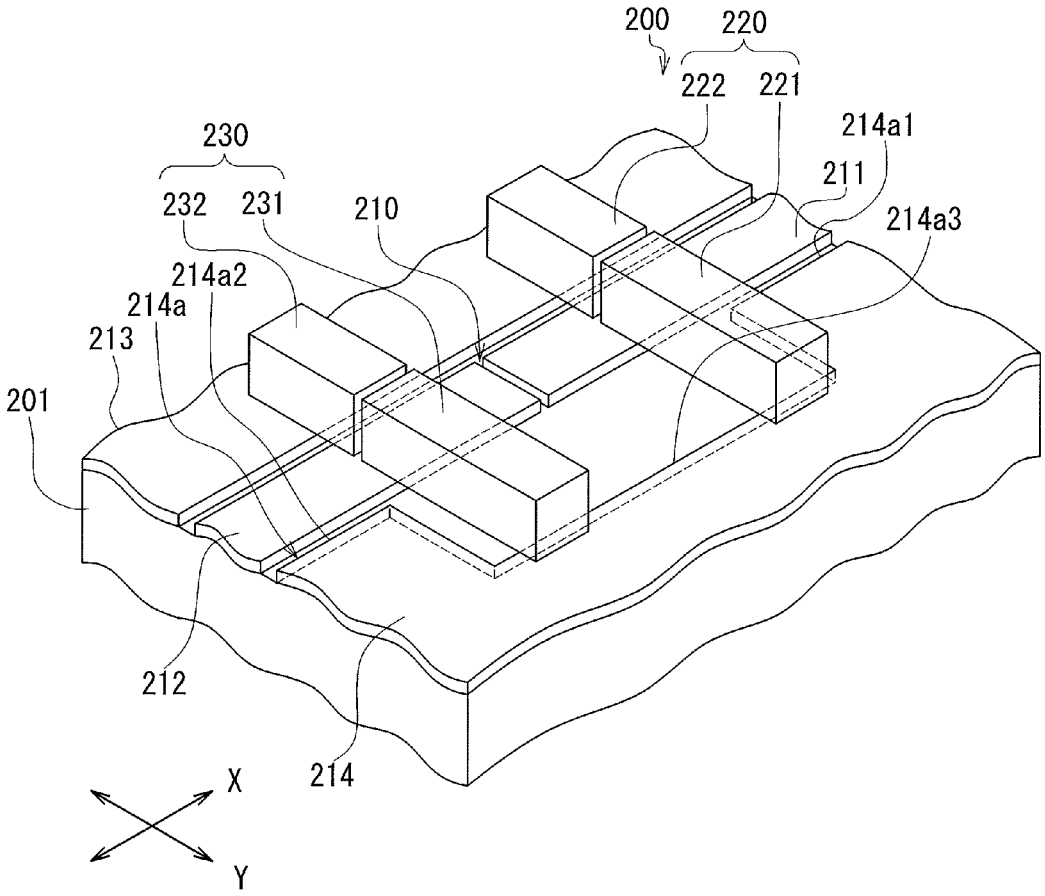
FIG. 24 is a perspective view of the electronic component shown in FIG. 23.

A dielectric line and an electronic component according to a fifth embodiment of the invention will now be described. FIG. 23 is a plan view of the electronic component according to the fifth embodiment. FIG. 24 is a perspective view of the electronic component shown in FIG. 23.

The electronic component 200 according to the fifth embodiment embodies a bandpass filter including two resonators. The electronic component 200 includes a dielectric substrate 201 having a top surface, and four conductor layers 211, 212, 213 and 214 disposed on the top surface of the dielectric substrate 201. The dielectric substrate 201 has a relative permittivity of 2.6.

The conductor layers 211 and 212 are both elongated in one direction, and are aligned in the one direction. A gap 210 of a predetermined size is formed between the conductor layers 211 and 212. Here, the direction in which the conductor layers 211 and 212 are aligned will be defined as the X direction, and the direction parallel to the top surface of the dielectric substrate 201 and orthogonal to the X direction will be defined as the Y direction. The conductor layers 213 and 214 are opposed to each other in the Y direction with the conductor layers 211 and 212 interposed therebetween.

The conductor layer 213 is spaced a certain distance apart from the conductor layers 211 and 212. The conductor layer 214 has a side 214*a* facing the conductor layers 211 and 212. The side 214*a* includes a first portion 214*a*1, a second portion 214*a*2 and a third portion 214*a*3. The first portion 214*a*1 is opposed to and spaced a first distance apart from a side of the conductor layer 211 facing the side 214*a*. The second portion 214*a*2 is opposed to and spaced a second distance apart from a side of the conductor layer 212 facing the side 214*a*. The third portion 214*a*3 is positioned between the first portion 214*a*1 and the second portion 214*a*2. The third portion 214*a*3 is opposed to and spaced a third distance apart from the side of each of the conductor layers 211 and 212 facing the side 214*a*. The first distance and the second distance are equal. The third distance is greater than the first distance and the second distance.

The dielectric substrate 201 and the conductor layers 211, 212, 213 and 214 constitute a coplanar line. The conductor layers 213 and 214 are connected to the ground. The conductor layers 211 and 212 transmit high-frequency signals.

The electronic component 200 further includes two dielectric blocks 221 and 231, and two chip-shaped capacitors 222 and 232. The dielectric blocks 221 and 231 are both shaped like a rectangular solid that is long in the Y direction. A portion of the dielectric block 221 near its one end in the Y direction is in contact with a portion of the top surface of the conductor layer 214 near the third portion 214*a*3 of the side 214*a*. A portion of the dielectric block 221 near its other end in the Y direction is in contact with the top surface of the conductor layer 211. A portion of the dielectric block 231 near its one end in the Y direction is in contact with a portion of the top surface of the conductor layer 214 near the third portion 214*a*3 of the side 214*a*. A portion of the dielectric block 231 near its other end in the Y direction is in contact with the top surface of the conductor layer 212. The capacitor 222 connects the conductor layer 211 and the conductor layer 213. The capacitor 232 connects the conductor layer 212 and the conductor layer 213. The capacitors 222 and 232 both have a capacitance of 0.6 pF.

The dielectric blocks 221 and 231 are both 1.6 mm long in the Y direction. In a cross section orthogonal to the Y direction, the dielectric blocks 221 and 231 are both in the shape of a square that is 0.5 mm long at each side. The dielectric blocks 221 and 231 are both formed of barium strontium titanate. Each of the dielectric blocks 221 and 231 forms the line portion of the dielectric line according to the fifth embodiment. The relative permittivity of each of the dielectric blocks 221 and 231, that is, the first relative permittivity E1, is 1,000. Electromagnetic waves propagate through the dielectric blocks 221 and 231 in the Y direction. The dielectric blocks 221 and 231 each have a quadrangular shape in the cross section orthogonal to the Y direction or the direction of propagation of the electromagnetic waves through the dielectric blocks 221 and 231.

The electronic component 200 further includes a surrounding dielectric portion (not illustrated) formed of the second dielectric having the second relative permittivity E2. In the cross section orthogonal to the direction of propagation of the electromagnetic waves through the dielectric blocks 221 and 231, the surrounding dielectric portion is present around the dielectric blocks 221 and 231. The second dielectric used to form the surrounding dielectric portion may be a dielectric material or air. The electronic component 200 includes a dielectric line composed of the dielectric block 221 and the surrounding dielectric portion, and a dielectric line composed of the dielectric block 231 and the surrounding dielectric portion.

Figure 25:
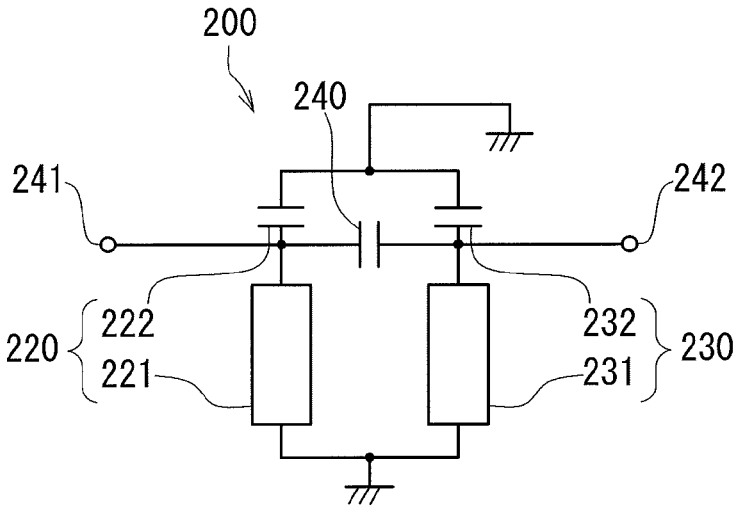
FIG. 25 is a circuit diagram illustrating the circuit configuration of the electronic component shown in FIG. 23.

FIG. 25 is a circuit diagram illustrating the circuit configuration of the electronic component 200 shown in FIG. 23. The electronic component 200 includes an input 241, an output 242, resonators 220 and 230, and a capacitor 240. The resonator 220 is composed of the dielectric block 221 and the capacitor 222 connected in parallel. The resonator 230 is composed of the dielectric block 231 and the capacitor 232 connected in parallel. Each of the dielectric blocks 221 and 231 functions as an inductor.

The input 241 is formed by the conductor layer 211. Each of the dielectric block 221 and the capacitor 222 has a first end connected to the input 241 (the conductor layer 211). The dielectric block 221 has a second end connected to the ground (the conductor layer 214). The capacitor 222 has a second end connected to the ground (the conductor layer 213).

The output 242 is formed by the conductor layer 212. Each of the dielectric block 231 and the capacitor 232 has a first end connected to the output 242 (the conductor layer 212). The dielectric block 231 has a second end connected to the ground (the conductor layer 214). The capacitor 232 has a second end connected to the ground (the conductor layer 213).

The capacitor 240 is composed of the conductor layers 211 and 212, and the gap 210 between the conductor layers 211 and 212. The capacitor 240 has a first end connected to the input 241 (the conductor layer 211), and a second end connected to the output 242 (the conductor layer 212).

The resonator 220 and the resonator 230 are electromagnetically coupled to each other. This electromagnetic coupling includes inductive coupling between the dielectric blocks 221 and 231 and capacitive coupling created by the capacitor 240.

The resonators 220 and 230 were actually produced. Each of the resonators 220 and 230 had a resonant frequency of 7.04 GHz and an unloaded Q of 98.6. A resonator of a comparative example was also produced for comparison with the resonators 220 and 230. The resonator of the comparative example was composed of an inductor formed of a conductor layer of Ag, and the capacitor 222. This inductor was provided in place of the dielectric block 221. The resonator of the comparative example had a resonant frequency of 5.86 GHz and an unloaded Q of 60.4. It was thus confirmed that the fifth embodiment was able to realize a resonator having a higher unloaded Q than the resonator of the comparative example.

Figure 26:
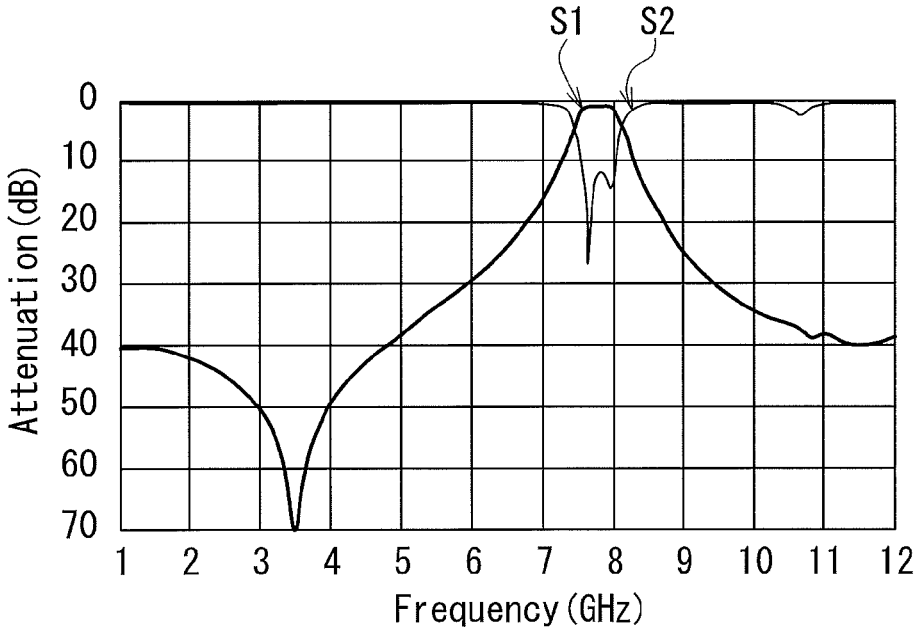
FIG. 26 is a characteristic diagram illustrating the frequency characteristics of the electronic component shown in FIG. 23.

FIG. 26 is a characteristic diagram illustrating the frequency characteristics of the electronic component 200 shown in FIG. 23. In FIG. 26, the horizontal axis represents frequency, and the vertical axis represents attenuation. In FIG. 26, the curve labeled S1 indicates the insertion loss characteristic of the electronic component 200, and the curve labeled S2 indicates the return loss characteristic of the electronic component 200. FIG. 26 indicates that the electronic component 200 embodies a bandpass filter. This bandpass filter has a passband center frequency of 7.8 GHz, and a passband width of 0.6 GHz. The passband of the bandpass filter is the frequency range in which the insertion loss characteristic S1 of the bandpass filter shows an attenuation of 3 dB or smaller.

[Sixth Embodiment]

Figure 27:
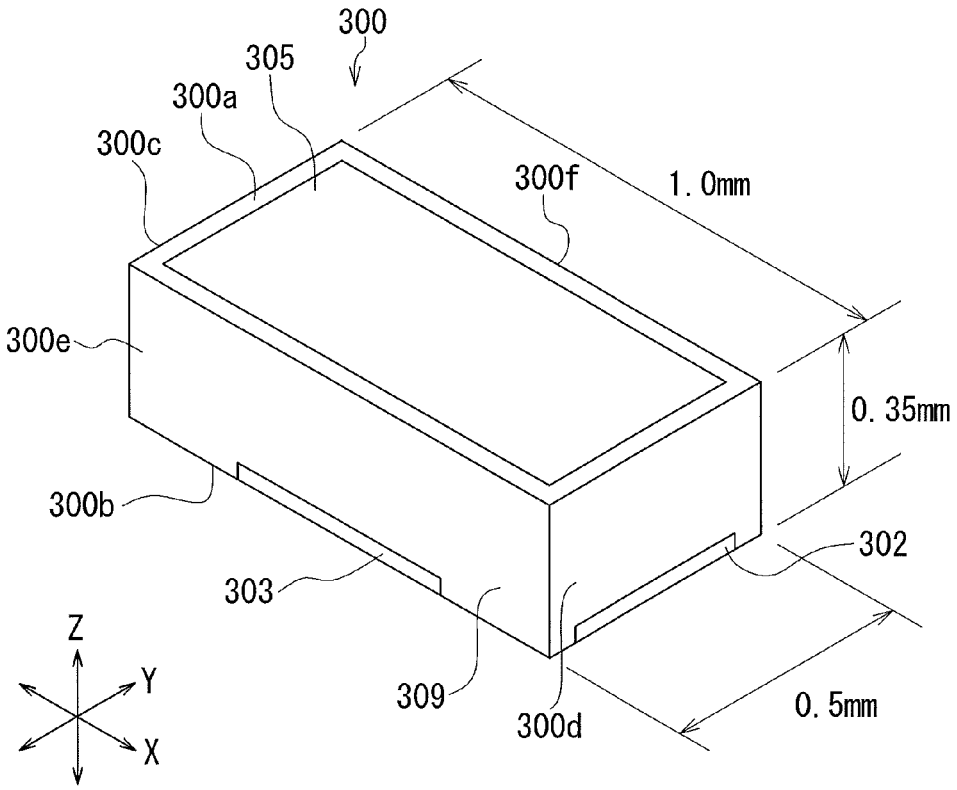
FIG. 27 is a perspective view of an electronic component according to a sixth embodiment of the invention.
Figure 28:
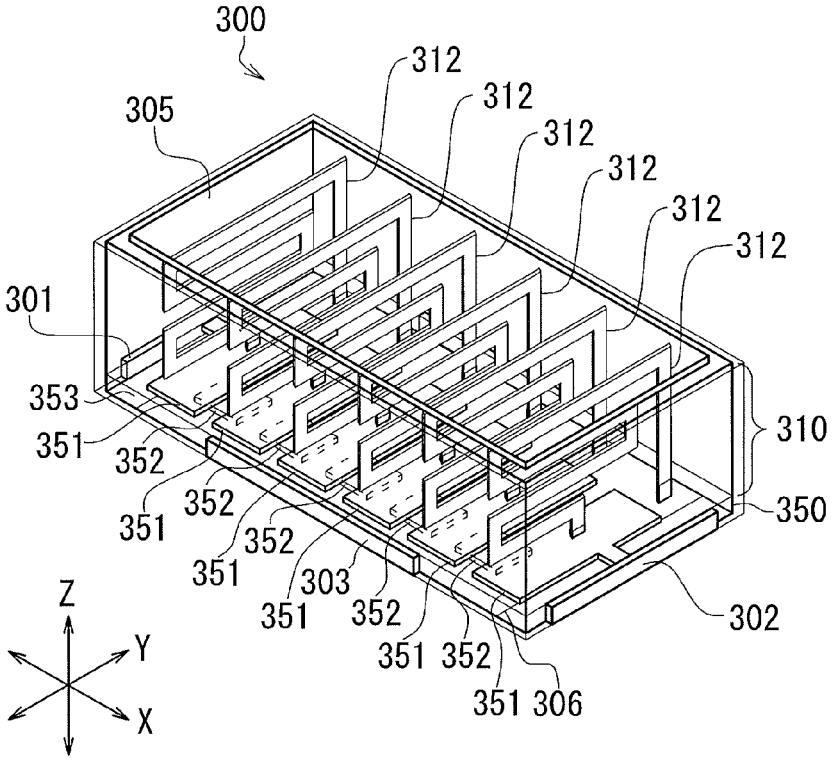
FIG. 28 is a perspective view showing the interior of the electronic component shown in FIG. 27.

A dielectric line and an electronic component according to a sixth embodiment of the invention will now be described. FIG. 27 is a perspective view of the electronic component according to the sixth embodiment. FIG. 28 is a perspective view showing the interior of the electronic component shown in FIG. 27. As shown in FIG. 27, the electronic component 300 according to the sixth embodiment has a rectangular-solid shape. Here, the X, Y and Z directions are defined as shown in FIG. 27. The X, Y and Z directions are orthogonal to one another. The electronic component 300 has a top surface 300*a* and a bottom surface 300*b* lying at opposite ends in the Z direction, two side surfaces 300*c* and 300*d* lying at opposite ends in the X direction, and two side surfaces 300*e* and 300*f* lying at opposite ends in the Y direction. As shown in FIG. 27, the electronic component 300 has dimensions of, for example, 1.0 mm, 0.5 mm and 0.35 mm in the X direction, the Y direction and the Z direction, respectively.

Figure 29:
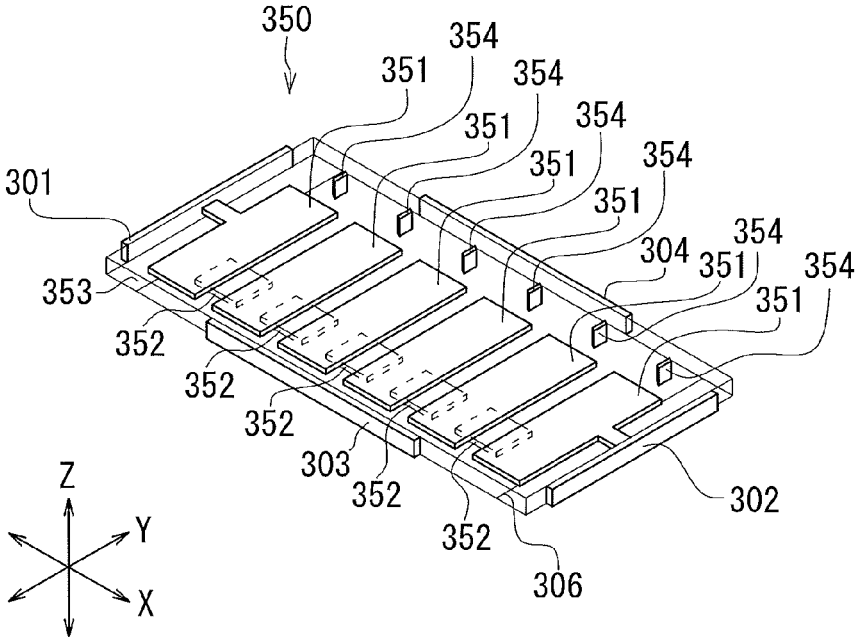
FIG. 29 is a perspective view of a capacitor section of the electronic component shown in FIG. 28.

As shown in FIG. 28, the electronic component 300 includes an inductor section 310 and a capacitor section 350. FIG. 29 is a perspective view of the capacitor section 350. The inductor section 310 lies on the capacitor section 350. As shown in FIG. 27, the electronic component 300 further includes a coating layer 309 of an insulating material covering the inductor section 310 and the capacitor section 350.

The electronic component 300 includes an input terminal 310 (see FIG. 28 and FIG. 29) exposed in the side surface 300*c*, an output terminal 302 exposed in the side surface 300*d*, ground terminals 303 and 304 (see FIG. 29) exposed in the side surfaces 300*e* and 300*f*, respectively, an external shield layer 305 exposed in the top surface 300*a*, and a ground layer 306 exposed in the bottom surface 300*b*. The input terminal 301, the output terminal 302, the ground terminals 303 and 304, the external shield layer 305 and the ground layer 306 are each formed of a conductor. The ground terminals 303 and 304 are electrically connected to the ground layer 306. The inductor section 310 includes six dielectric lines aligned in the X direction. The six dielectric lines will be described in detail later.

As shown in FIG. 29, the capacitor section 350 includes six capacitor-forming conductor layers 351 disposed above the ground layer 306. The six capacitor-forming conductor layers 351 are aligned in the X direction. One of the capacitor-forming conductor layers 351 that is closest to the input terminal 301 is electrically connected to the input terminal 301. Another one of the capacitor-forming conductor layers 351 that is closest to the output terminal 302 is electrically connected to the output terminal 302.

The capacitor section 350 further includes five capacitor-forming conductor layers 352 disposed between the ground layer 306 and the capacitor-forming conductor layers 351. When viewed in the Z direction, each single capacitor-forming conductor layer 352 is positioned to overlap two capacitor-forming conductor layers 351 adjacent to each other.

The capacitor section 350 further includes a dielectric substrate 353 supporting the ground layer 306, the six capacitor-forming conductor layers 351 and the five capacitor-forming conductor layers 352. The dielectric substrate 353 has a relative permittivity of 100, for example. The dielectric substrate 353 has a relative permeability of 1.

A combination of one dielectric line in the inductor section 310 and a portion of the capacitor section 350 located thereunder will be referred to as a resonator portion 360. The electronic component 300 includes six resonator portions 360 aligned in the X direction.

Figure 30:
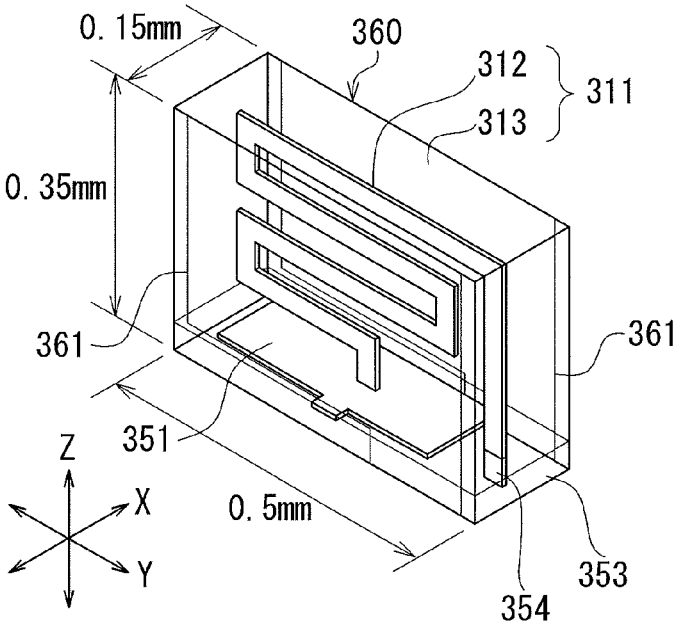
FIG. 30 is a perspective view showing the interior of a resonator portion of the electronic component shown in FIG. 28.

FIG. 30 is a perspective view showing the interior of one resonator portion 360. The resonator portion 360 shown in FIG. 30 is the one closest to the output terminal 302. As shown in FIG. 30, the dielectric line 311 includes a line portion 312, and a surrounding dielectric portion 313 present around the line portion 312. The line portion 312 is embedded in the surrounding dielectric portion 313. The surrounding dielectric portion 313 has a rectangular-solid shape. The entire line portion 312 is meandering in shape when viewed in the X direction. One or more electromagnetic waves are propagated through the line portion 312 in the direction in which the line portion 312 extends. In a cross section orthogonal to the direction of propagation of the one or more electromagnetic waves through the line portion 312, the surrounding dielectric portion 313 is present around the line portion 312. In the sixth embodiment, in particular, the surrounding dielectric portion 313 is in contact with the entire perimeter of the line portion 312 in the aforementioned cross section. In the aforementioned cross section the line portion 312 has a quadrangular shape, especially a rectangular shape.

The line portion 312 is formed of a first dielectric having a first relative permittivity E1. In the sixth embodiment, the first relative permittivity E1 is 500,000, for example, and the first dielectric has a dielectric loss tangent of 0.001, for example. The surrounding dielectric portion 313 is formed of a second dielectric having a second relative permittivity E2. In the sixth embodiment, the second relative permittivity E2 is 20, for example, and the second dielectric has a dielectric loss tangent of 0.001, for example. The second dielectric has a relative permeability in the range of 1 to 23, for example.

Each resonator portion 360 includes a corresponding one of the capacitor-forming conductor layers 351. One end of the line portion 312 is connected to the capacitor-forming conductor layer 351. Each resonator portion 360 further includes a conductor section 354 connecting the other end of the line portion 312 to the ground layer 306. The conductor section 354 is embedded in the dielectric substrate 353.

As shown in FIG. 30, each resonator portion 360 has dimensions of, for example, 0.15 mm, 0.5 mm and 0.35 mm in the X direction, the Y direction and the Z direction, respectively.

Figure 31:
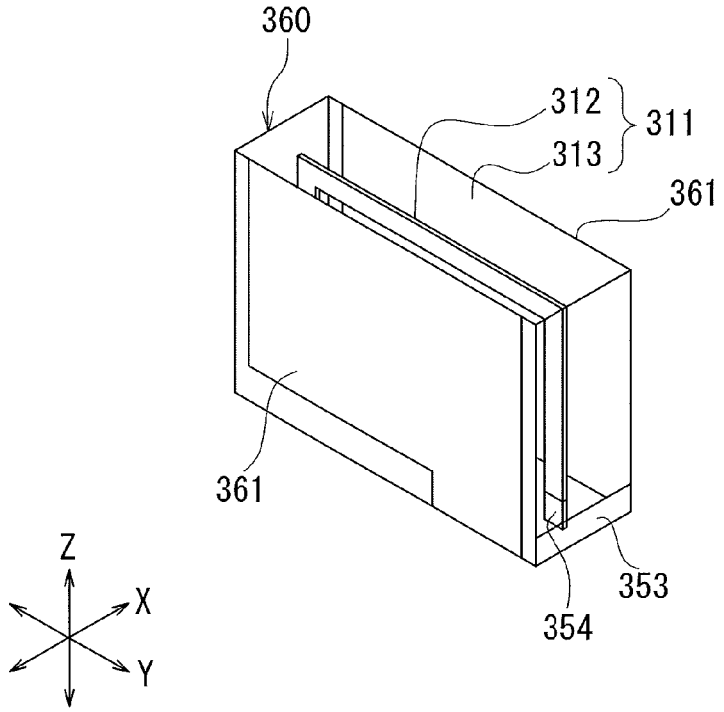
FIG. 31 is a perspective view showing the resonator portion of FIG. 30 with two partition shield layers.

The electronic component 300 includes a plurality of partition shield layers 361. Each partition shield layer 361 is disposed between two adjacent resonator portions 360 or on the outer surface of one of two resonator portions 360 that are located at opposite ends in the X direction. FIG. 31 shows one resonator portion 360 and two partition shield layers 361 located on opposite sides thereof.

Figure 32:
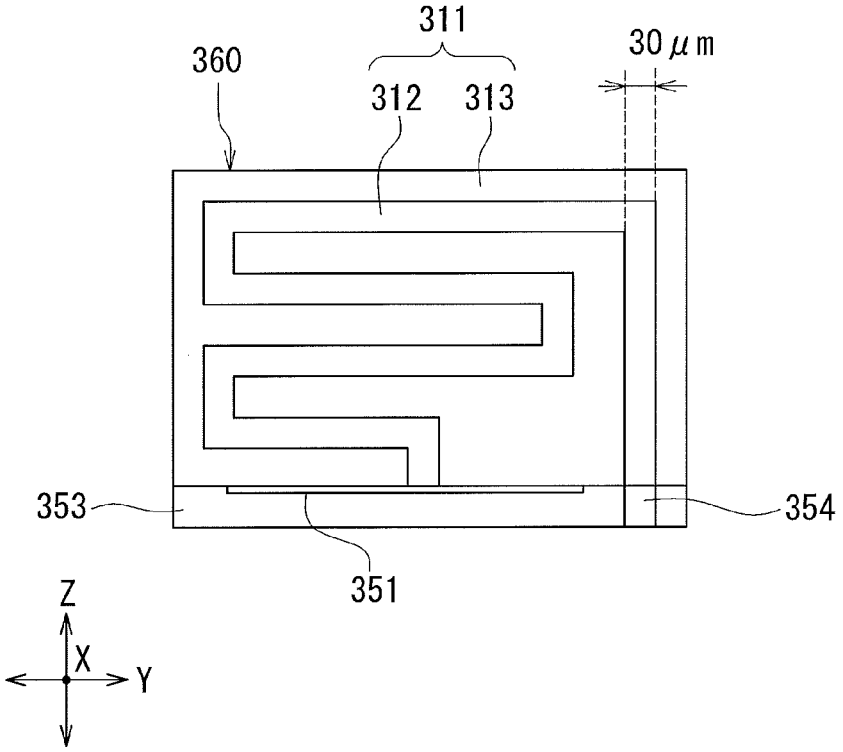
FIG. 32 is a front view of the resonator portion shown in FIG. 30.
Figure 33:
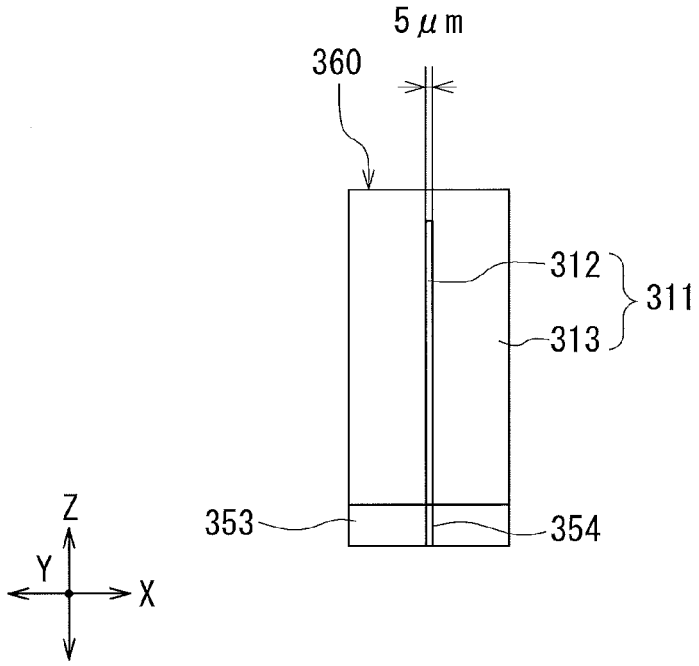
FIG. 33 is a side view of the resonator portion shown in FIG. 30.

FIG. 32 is a front view of the resonator portion 360 as viewed in the X direction. FIG. 33 is a side view of the resonator portion 360 as viewed in the Y direction. As shown in FIG. 32, the line portion 312 as viewed in the X direction has a width of 30 μm, for example. As shown in FIG. 33, the line portion 312 as viewed in the Y direction has a thickness of 5 μm, for example.

Figure 34:
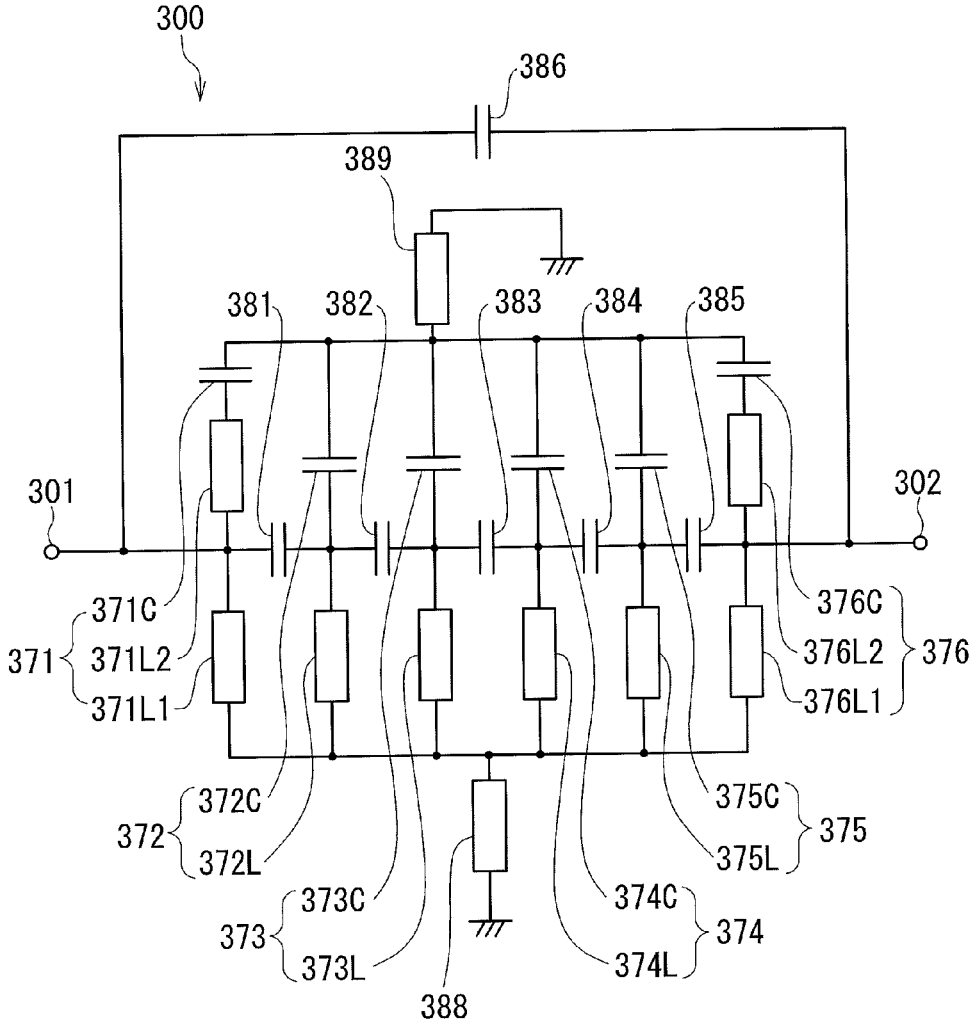
FIG. 34 is a circuit diagram illustrating the circuit configuration of the electronic component shown in FIG. 28.

FIG. 34 is a circuit diagram illustrating the circuit configuration of the electronic component 300. The electronic component 300 includes an input terminal 301, an output terminal 302, six resonators 371 to 376, six capacitors 381 to 386, and two inductors 388 and 389. Any adjacent two of the six resonators 371 to 376 are electromagnetically coupled to each other.

The resonator 371 is composed of inductors 371L1 and 372L2 and a capacitor 371C. Each of the inductors 371L1 and 371L2 has a first end connected to the input terminal 301. The capacitor 371C has a first end connected to a second end of the inductor 371L2. The inductor 371L1 is formed by one of the dielectric lines 312 that is closest to the input terminal 301. The inductor 371L2 is formed by one of the capacitor-forming conductor layers 351 that is closest to the input terminal 301. The capacitor 371C is composed of the one of the capacitor-forming conductor layers 351 that is closest to the input terminal 301, the ground layer 306, and a portion of the dielectric substrate 353 located therebetween.

The resonator 372 is composed of an inductor 372L and a capacitor 372C. The resonator 373 is composed of an inductor 373L and a capacitor 373C. The resonator 374 is composed of an inductor 374L and a capacitor 374C. The resonator 375 is composed of an inductor 375L and a capacitor 375C.

The inductors 372L, 373L, 374L and 375L are formed by four line portions 312 that are other than the line portion 312 closest to the input terminal 301 and the line portion 312 closest to the output terminal 302. Each of the capacitors 372C, 373C, 374C and 375C is composed of a corresponding one of four capacitor-forming conductor layers 351 that are other than the capacitor-forming conductor layer 351 connected to the input terminal 301 and the capacitor-forming conductor layer 351 connected to the output terminal 302, the ground layer 306, and a portion of the dielectric substrate 353 located therebetween.

The resonator 376 is composed of inductors 376L1 and 376L2 and a capacitor 376C. Each of the inductors 376L1 and 376L2 has a first end connected to the output terminal 302. The capacitor 376C has a first end connected to a second end of the inductor 376L2. The inductor 376L1 is formed by one of the line portions 312 that is closest to the output terminal 302. The inductor 376L2 is formed by one of the capacitor-forming conductor layers 351 that is closest to the output terminal 302. The capacitor 376C is composed of the one of the capacitor-forming conductor layers 351 that is closest to the output terminal 302, the ground layer 306, and a portion of the dielectric substrate 353 located therebetween.

The capacitor 381 has a first end connected to the first end of each of the inductors 371L1 and 372L2. The capacitor 381 has a second end connected to a first end of each of the inductor 372L and the capacitor 372C. The capacitor 382 has a first end connected to the first end of each of the inductor 372L and the capacitor 372C. The capacitor 382 has a second end connected to a first end of each of the inductor 373L and the capacitor 373C. The capacitor 383 has a first end connected to the first end of each of the inductor 373L and the capacitor 373C. The capacitor 383 has a second end connected to a first end of each of the inductor 374L and the capacitor 374C. The capacitor 384 has a first end connected to the first end of each of the inductor 374L and the capacitor 374C. The capacitor 384 has a second end connected to a first end of each of the inductor 375L and the capacitor 375C. The capacitor 385 has a first end connected to the first end of each of the inductor 375L and the capacitor 375C. The capacitor 385 has a second end connected to the first end of each of the inductors 376L1 and the 376L2.

The capacitors 381 to 385 are formed by the five capacitor-forming conductor layers 352, the six capacitor-forming conductor layers 351, and portions of the dielectric substrate 353 located between the conductor layers 351 and 352. Each of the capacitors 381 to 385 is composed of one capacitor-forming conductor layer 352, two capacitor-forming conductor layers 351 located on opposite sides of the conductor layer 352, and a portion of the dielectric substrate 353 located between the conductor layers 351 and 352.

The inductor 388 has a first end connected to a second end of each of the inductors 371L1, 372L, 373L, 374L, 375L and 376L1. The inductor 388 has a second end connected to the ground. The inductor 389 has a first end connected to a second end of each of the capacitors 371C, 372C, 373C, 374C, 375C and 376C. The inductor 389 has a second end connected to the ground. The inductors 388 and 389 are formed by the ground layer 306.

The capacitor 386 has a first end connected to the input terminal 301, and a second end connected to the output terminal 302. The capacitor 386 is formed by a distributed capacitance generated between the line portion 312 closest to the input terminal 301 and the line portion 312 closest to the output terminal 302.

Figure 35:
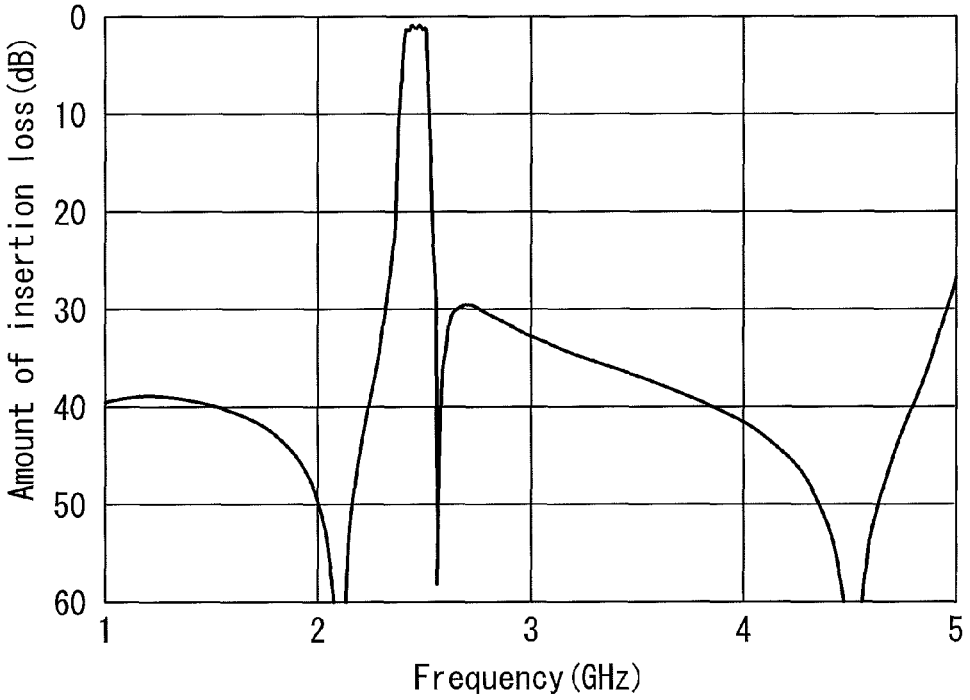
FIG. 35 is a characteristic diagram illustrating an example of insertion loss characteristics of the electronic component shown in FIG. 27.

The electronic component 300 embodies a six-stage quasi-elliptic function bandpass filter. FIG. 35 is a characteristic diagram illustrating an example of insertion loss characteristics of the electronic component 300 determined by a simulation. In FIG. 35, the horizontal axis represents frequency, and the vertical axis represents the amount of insertion loss. In this example, the relative permeability of the second dielectric forming the surrounding dielectric portion 313 is 23, and the capacitance of each of the capacitors 371C to 376C is 1.4 pF. In the example shown in FIG. 35, the electronic component 300 embodies a bandpass filter having a passband center frequency of 2.43 GHz.

A fifth simulation was conducted on the resonator portion 360 of the sixth embodiment as described below. The fifth simulation examined the relationships of the relative permeability and dielectric loss tangent of the second dielectric forming the surrounding dielectric portion 313 with the resonant frequency and unloaded Q of the resonator formed by the resonator portion 360. The fifth simulation used models M1 to M4 of the resonator portion 360. In the models M1 to M4, conditions other than the relative permeability and dielectric loss tangent of the second dielectric were as exemplified above for the resonator portion 360.

Figure 36:
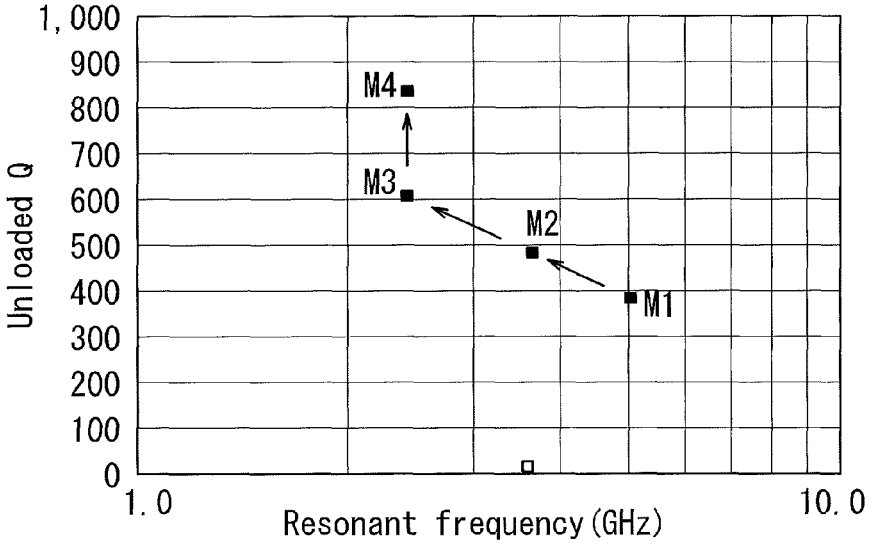
FIG. 36 is a characteristic diagram illustrating the characteristics of the resonator portion shown in FIG. 30.

The results of the fifth simulation are shown in Table 3 below and FIG. 36. In FIG. 36, the horizontal axis represents the resonant frequency of the resonator, and the vertical axis represents unloaded Q. In the fifth simulation, the resonant frequency and unloaded Q of the resonator were also determined for a model of a comparative example. In the model of the comparative example, the line portion 312 of the models M1 to M4 of the resonator portion 360 was replaced with a conductor line portion formed of Ag and having the same shape as the line portion 312, and the relative permeability of the surrounding dielectric portion 313 was set to 1.0. For the model of the comparative example, the resonant frequency of the resonator was 3.59 GHz, and the unloaded Q of the resonator was 22. In FIG. 36, the resonant frequency and the unloaded Q obtained with the model of the comparative example are indicated by a hollow square, and the resonant frequencies and the unloaded Qs obtained with the models M1 to M4 are indicated by filled squares. The unloaded Qs obtained with the models M1 to M4 are all higher than the unloaded Q obtained with the model of the comparative example. The arrows in FIG. 36 indicate that the unloaded Q increases in the order of models M1, M2, M3, and M4.

TABLE 3

| Model | Relative permeability of second dielectric | Dielectric loss tangent of second dielectric | Resonant frequency (GHz) | Unloaded Q |
|---|---|---|---|---|
| M1 | 5 | 0.001 | 5.04 | 387 |
| M2 | 10 | 0.001 | 3.64 | 486 |
| M3 | 23 | 0.001 | 2.43 | 608 |
| M4 | 23 | 0.0005 | 2.43 | 839 |

Table 3 and FIG. 36 indicate that in the models of the resonator portion 360 used in the fifth simulation, as the relative permeability of the surrounding dielectric portion 313 increases, the resonant frequency decreases and the unloaded Q increases. Therefore, as the relative permeability of the surrounding dielectric portion 313 increases, it becomes easier to realize a resonator having a resonant frequency within the range of 1 to 10 GHz and a high unloaded Q. Table 3 and FIG. 36 also indicate that the unloaded Q of the resonator can be increased by reducing the dielectric loss tangent of the second dielectric.

The present invention is not limited to the foregoing embodiments, and various modifications may be made thereto. For example, when the surrounding dielectric portion includes a magnetic dielectric portion and a nonmagnetic dielectric portion, the magnetic dielectric portion may be provided to be in contact with only a portion of the entire perimeter of the line portion in a cross section orthogonal to the direction of propagation of the one or more electromagnetic waves through the line portion. Further, the electronic component of the present invention is not limited to one that includes a resonator formed using the dielectric line of the present invention, but can have any other configuration including at least the dielectric line of the present invention. For example, the electronic component of the present invention may be one including a circuit other than a resonator, such as an antenna, a directional coupler, a matching circuit or a transformer, formed using the dielectric line of the present invention.

It is apparent that the present invention can be carried out in various forms and modifications in the light of the foregoing descriptions. Accordingly, within the scope of the following claims and equivalents thereof, the present invention can be carried out in forms other than the foregoing most preferable embodiments.

What is claimed is:

1. A dielectric line comprising:

a line portion formed of a first dielectric and including no conductor, the first dielectric having a first relative permittivity of 1,000 or higher, the line portion being configured to propagate one or more electromagnetic waves of one or more frequencies within a range of 1 to 10 GHz; and a surrounding dielectric portion formed of a second dielectric having a second relative permittivity lower than the first relative permittivity, wherein in a cross section orthogonal to a direction of propagation of the one or more electromagnetic waves through the line portion, the surrounding dielectric portion is present around the line portion and in contact with an entire perimeter of the line portion.

2. The dielectric line according to claim 1, wherein the first relative permittivity is 500,000 or lower.

3. The dielectric line according to claim 1, wherein the second relative permittivity is no higher than one-tenth of the first relative permittivity.

4. The dielectric line according to claim 1, wherein at least part of the surrounding dielectric portion has a relative permeability of 1.02 or higher.

5. The dielectric line according to claim 4, wherein the relative permeability of the at least part of the surrounding dielectric portion is 30 or lower.

6. The dielectric line according to claim 1, wherein the line portion has a circular shape in the cross section.

7. The dielectric line according to claim 1, wherein the line portion has a quadrangular shape in the cross section.

8. An electronic component including the dielectric line of claim 1.

9. The electronic component according to claim 8, comprising a resonator having a resonant frequency within the range of 1 to 10 GHz, wherein the resonator is formed using the dielectric line.

* * * * *